United States Patent [19]

Emert et al.

[11] Patent Number: 5,053,150

[45] Date of Patent: Oct. 1, 1991

[54] POLYEPOXIDE MODIFIED ADDUCTS OR REACTANTS AND OLEAGINOUS COMPOSITIONS CONTAINING SAME

[75] Inventors: Jacob Emert, Brooklyn, N.Y.; Robert D. Lundberg, Bridgewater, N.J.

[73] Assignee: Exxon Chemical Patents Inc., Linden, N.J.

[21] Appl. No.: 625,623

[22] Filed: Dec. 4, 1990

Related U.S. Application Data

[63] Continuation of Ser. No. 161,899, Feb. 29, 1988, abandoned.

[51] Int. Cl.[5] ..... C10M 133/56; C10M 133/58

[52] U.S. Cl. ..... 252/51.5 A; 252/51.5 R; 548/520; 548/546

[58] Field of Search ..... 252/51.5 A, 51.5 R; 548/520, 546

[56] References Cited

U.S. PATENT DOCUMENTS

| | | | |
|---|---|---|---|
| 3,078,271 | 2/1963 | De Groote et al. | 260/247.5 |
| 3,188,362 | 6/1965 | Delmonte | 260/835 |
| 3,272,746 | 9/1966 | Le Suer et al. | 252/47.5 |
| 3,336,241 | 8/1967 | Shokal | 260/2 |
| 3,367,943 | 2/1968 | Miller | 260/326.3 |
| 3,373,111 | 3/1968 | Le Suer et al. | 252/51.5 |
| 3,381,022 | 4/1968 | Le Suer | 260/404.8 |
| 3,386,953 | 6/1968 | Dunning et al. | 260/47 |
| 3,442,808 | 5/1969 | Traise | 252/49.6 |
| 3,458,530 | 7/1969 | Siegel et al. | 260/326.5 |
| 3,477,990 | 11/1969 | Dante et al. | 260/47 |
| 3,539,633 | 11/1970 | Plasek et al. | 260/570.5 |
| 3,579,450 | 5/1971 | Le Suer et al. | 252/56 |
| 3,591,598 | 7/1971 | Traise et al. | 260/296 |
| 3,630,904 | 12/1971 | Musser et al. | 252/51.5 |
| 3,679,632 | 7/1972 | Flowers et al. | 260/47 |
| 3,705,109 | 12/1972 | Hausler et al. | 252/392 |
| 3,836,470 | 9/1974 | Miller | 252/51.5 |
| 3,836,471 | 9/1974 | Miller | 252/51.5 |
| 3,842,010 | 10/1974 | Pappas et al. | 252/51.5 |
| 3,850,826 | 11/1974 | de Vries | 252/51.5 |
| 3,859,318 | 1/1975 | Le Suer | 260/410.6 |
| 3,879,308 | 4/1975 | Miller | 252/56 |
| 3,957,854 | 5/1976 | Miller | 260/482 |
| 3,957,855 | 5/1976 | Miller | 260/482 |
| 3,962,182 | 6/1976 | Steele | 260/47 EN |
| 4,097,389 | 6/1978 | Andress, Jr. | 252/51.5 |
| 4,129,508 | 12/1978 | Friihauf | 252/33 |
| 4,189,450 | 2/1980 | Kempter et al. | 525/529 |
| 4,234,435 | 11/1980 | Meinhardt et al. | 252/51.5 |
| 4,340,455 | 7/1982 | Kempter et al. | 525/490 |
| 4,376,849 | 3/1983 | Kempter et al. | 525/490 |
| 4,428,849 | 12/1984 | Wisotsky | 252/33.4 |
| 4,455,243 | 6/1984 | Liston | 252/49.6 |
| 4,482,464 | 11/1984 | Karol et al. | 252/51.5 |
| 4,492,642 | 12/1985 | Horodysky | 252/49 |
| 4,517,104 | 6/1985 | Bloch et al. | 252/51.5 |
| 4,548,724 | 10/1985 | Karol et al. | 252/51.5 |
| 4,579,674 | 4/1986 | Schlicht | 252/51.5 |
| 4,617,137 | 10/1986 | Plavac | 252/49 |
| 4,663,064 | 5/1987 | Nalesnik et al. | 252/51.5 |
| 4,720,350 | 1/1988 | Zoleski et al. | 252/51.5 |

FOREIGN PATENT DOCUMENTS

| | | |
|---|---|---|
| 0317353 | 5/1989 | European Pat. Off. . |

*Primary Examiner*—Prince E. Willis
*Assistant Examiner*—Jerry D. Johnson
*Attorney, Agent, or Firm*—M. Kapustij; E. R. Skula

[57] ABSTRACT

A compound useful as a dispersant additive in oleaginous compositions selected from fuels and lubricating oils comprising the reaction products of:

(i) at least one intermediate adduct comprised of the reaction products of
  (a) at least one polyepoxide, and
  (b) at least one member selected from the group consisting of polyamines, polyols, and amino alcohols; and (ii) at least one of (a) hydrocarbyl substituted $C_4$-$C_{10}$ dicarboxylic acid producing material or (b) an aldehyde and a hydrocarbyl substituted hydroxy aromatic compound.

Also included is a process for preparing said compound and an oleaginous composition containing said compound.

65 Claims, No Drawings

POLYEPOXIDE MODIFIED ADDUCTS OR REACTANTS AND OLEAGINOUS COMPOSITIONS CONTAINING SAME

This is a continuation of application Ser. No. 161,899, filed Feb. 29, 1988, now abandoned.

FIELD OF THE INVENTION

This invention relates to oil soluble dispersant additives useful in oleaginous compositions selected from fuel and lubricating oil compositions, including concentrates containing said additives, and methods for their manufacture and use. The dispersant additives are polyepoxide adducts which have been prepared by first reacting a polyepoxide with a polyamine, a polyol or an amino alcohol to form an intermediate adduct, whereafter the intermediate adduct is reacted with at least one of (a) a dicarboxylic acid, anhydride, ester, etc. which in turn has been substituted with a high molecular weight hydrocarbon group or (b) an aldehyde and a hydrocarbyl substituted hydroxy aromatic compound. The high molecular weight hydrocarbon group has a number average molecular weight ($\overline{M}_n$) of about 500 to about 6,000.

BACKGROUND OF THE INVENTION

Multigrade lubricating oils typically are identified by two numbers such as 1OW30, 5W30 etc. The first number in the multigrade designation is associated with a maximum low temperature (e.g. −20° C.) viscosity requirement for that multigrade oil as measured typically by a cold cranking simulator (CCS) under high shear, while the second number in the multigrade designation is associated with a minimum high temperature (e.g. 100° C.) viscosity requirement. Thus, each particular multigrade oil must simultaneously meet both strict low and high temperature viscosity requirements in order to qualify for a given multigrade oil designation. Such requirements are set e.g., by ASTM specifications. By "low temperature" as used herein is meant temperatures of typically from about −30 to about −5° C. By "high temperature" as used herein is meant temperatures of typically at least about 100° C.

The minimum high temperature viscosity requirement, e.g. at 100° C., is intended to prevent the oil from thinning out too much during engine operation which can lead to excessive wear and increased oil consumption. The maximum low temperature viscosity requirement is intended to facilitate engine starting in cold weather and to ensure pumpability, i.e., the cold oil should readily flow or slump into the well for the oil pump, otherwise the engine can be damaged due to insufficient lubrication.

In formulating an oil which efficiently meets both low and high temperature viscosity requirements, the formulator may use a single oil of desired viscosity or a blend of two lubricating oils of different viscosities, in conjunction with manipulating the identity and amount of additives that must be present to achieve the overall target properties of a particular multigrade oil including its viscosity requirements.

The natural viscosity characteristic of a lubricating oil is typically expressed by the neutral number of the oil (e.g. S150N) with a higher neutral number being associated with a higher natural viscosity at a given temperature. In some instances the formulator will find it desirable to blend oils of two different neutral numbers, and hence viscosities, to achieve an oil having a viscosity intermediate between the viscosity of the components of the oil blend. Thus, the neutral number designation provides the formulator with a simple way to achieve a desired base oil of predictable viscosity. Unfortunately, merely blending oils of different viscosity characteristics does not enable the formulator to meet the low and high temperature viscosity requirements of multigrade oils. The formulator's primary tool for achieving this goal is an additive conventionally referred to as a viscosity index improver (i.e., V.I. improver).

The V. I. improver is conventionally an oil-soluble long chain polymer. The large size of these polymers enables them to significantly increase Kinematic viscosities of base oils even at low concentrations. However, because solutions of high polymers are non-Newtonian they tend to give lower viscosities than expected in a high shear environment due to the alignment of the polymer. Consequently, V.I. improvers impact (i.e., increase) the low temperature (high shear) viscosities (i.e. CCS viscosity) of the base oil to a lesser extent than they do the high temperature (low shear) viscosities.

The a foresaid viscosity requirements for a multigrade oil can therefore be viewed as being increasingly antagonistic at increasingly higher levels of V.I. improver. For example, if a large quantity of V.I. improver is used in order to obtain high viscosity at high temperatures, the oil may now exceed the low temperature requirement. In another example, the formulator may be able to readily meet the requirement for a 1OW30 oil but not a 5W30 oil, with a particular ad-pack (additive package) and base oil. Under these circumstances the formulator may attempt to lower the viscosity of the base oil, such as by increasing the proportion of low viscosity oil in a blend, to compensate for the low temperature viscosity increase induced by the V.I. improver, in order to meet the desired low and high temperature viscosity requirements. However, increasing the proportion of low viscosity oils in a blend can in turn lead to a new set of limitations on the formulator, as lower viscosity base oils are considerably less desirable in diesel engine use than the heavier, more viscous oils. In addition the added volatility of lower viscosity base oil can present a practical problem.

Further complicating the formulator's task is the effect that dispersant additives can have on the viscosity characteristics of multigrade oils. Dispersants are frequently present in quality oils such as multigrade oils, together with the V.I. improver. The primary function of a dispersant is to maintain oil insolubles, resulting from oxidation during use, in suspension in the oil thus preventing sludge flocculation and precipitation. Consequently, the amount of dispersant employed is dictated and controlled by the effectiveness of the material for achieving its dispersant function. A high quality 10W30 commercial oil might contain from two to four times as much dispersant as V.I. improver (as measured by the respective dispersant and V.I. improver active ingredients). In addition to dispersancy, conventional dispersants can also increase the low and high temperature viscosity characteristics of a base oil simply by virtue of their polymeric nature. In contrast to the V.I. improver, the dispersant molecule is much smaller. Consequently, the dispersant is much less shear sensitive, thereby contributing more to the low temperature CCS viscosity (relative to its contribution to the high temperature viscosity of the base oil) than a V.I. improver. Moreover, the smaller dispersant molecule contributes much less to the high temperature viscosity of the base oil than the V.I. improver. Thus, the magnitude of the low temperature viscosity increase induced by the dispersant can exceed the low temperature viscosity increase induced by the V.I. improver without the benefit of a proportionately greater increase in high temperature viscosity as obtained from a V.I. improver. Consequently, as the dispersant induced low temperature viscosity increase causes the low temperature viscosity of the oil to approach the maximum low temperature viscosity limit, the more difficult it is to introduce a sufficient amount of V.I. improver effective to meet the high temperature viscosity requirement and still meet the low temperature viscosity requirement. The formulator is thereby once again forced to shift to the undesirable expedient of using higher proportions of low viscosity oil to permit addition of the requisite amount of V.I. improver without exceeding the low temperature viscosity limit.

In accordance with the present invention, dispersants are provided which have been found to possess inherent characteristics such that they contribute considerably less to low temperature viscosity increases than dispersants of the prior art while achieving similar high temperature viscosity increases. Moreover, as the concentration of dispersant in the base oil is increased, this beneficial low temperature viscosity effect becomes increasingly more pronounced relative to conventional dispersants. This advantage is especially significant for high quality heavy duty diesel oils which typically require high concentrations of dispersant additive. Furthermore, these improved viscosity properties facilitate the use of V.I. improvers in forming multigrade oils spanning a wider viscosity requirement range, such as 5W30 oils, due to the overall effect of lower viscosity increase at low temperatures while maintaining the desired viscosity at high temperatures as compared to the other dispersants. More significantly, these viscometric properties also permit the use of higher viscosity base stocks with attendant advantages in engine performance. Furthermore, the utilization of the dispersant additives of the instant invention allows a reduction in the amount of V.I. improvers required.

The materials of this invention are thus an improvement over conventional dispersants because of their effectiveness as dispersants coupled with enhanced low temperature viscometric properties These materials are particularly useful with V.I. improvers in formulating multigrade oils.

SUMMARY OF THE INVENTION

The present invention is directed to oil soluble dispersant additives useful in oleaginous compositions selected from fuels and lubricating oils comprising the reaction products of:

(i) at least one intermediate adduct comprised of the reaction products of
  (a) at least one polyepoxide, and
  (b) at least one member selected from the group consisting of polyamines, polyols, and amino alcohols; and
(ii) at least one of (a) a hydrocarbyl substituted $C_4$–$C_{10}$ dicarboxylic acid producing material or (b) an aldehyde and a hydrocarbyl substituted hydroxy aromatic compound.

The intermediate adduct (i) is first performed and this performed intermediate adduct is subsequently reacted with (ii).

DETAILED DESCRIPTION OF THE INVENTION

In accordance with the present invention there are provided oil soluble dispersant compositions. These dispersants exhibit a high temperature to low temperature viscosity balance or ratio which is more favorable than that of conventional dispersant materials. That is to say the instant dispersant materials possess inherent characteristics such that they contribute considerably less to low temperature viscosity increase than conventional dispersants while increasing the contribution to the high temperature viscosity increase They also exhibit enhanced and improved dispersancy characteristics. This is believed to be due, inter alia, to the presence of the hydroxyl groups formed as a result of the ring opening of the oxirane rings in their reaction with the reactive amino groups of the polyamine or hydroxyl groups of the polyol in the formation of the intermediate adduct (i).

The dispersant materials of the instant invention comprise the reaction products of (i) at least one intermediate adduct comprised of the reaction products of
  (a) at least one polyepoxide, and
  (b) at least one member selected from the group consisting of polyamines, polyols, and amino alcohols; and
(ii) at least one of (a) a hydrocarbyl substituted $C_4$–$C_{10}$ dicarboxylic acid producing material or (b) an aldehyde and a hydrocarbyl substituted hydroxy aromatic compound.

The reaction product (i), also referred to in the specification and appended claims as the intermediate adduct, is then reacted with (ii)(a) or (ii)(b), with (ii) (a) being referred to in the specification and appended claims as an acylating agent or material, to form the adduct or dispersant of the present invention. If (i)(b) is a polyamine then it contains at least two reactive amino groups, one of said amino groups being a primary amino group and the other reactive amino group being a primary amino group or a secondary amino group.

In a preferred embodiment of the instant invention (i)(b) is a polyamine, and in the following discussion concerning the reaction between (i)(a) and (i)(b) to form the intermediate adduct, (i)(b) will be assumed to be such a polyamine.

In another preferred embodiment (i)(b) is a polyamine and (ii) is (a).

For purposes of illustration and exemplification only the reaction between one mole of a polyepoxide, i.e., a diepoxide, and two moles of a polyamine such as tetraethylene pentamine (TEPA), to form the intermediate adduct is believed to be represented by the following reaction scheme:

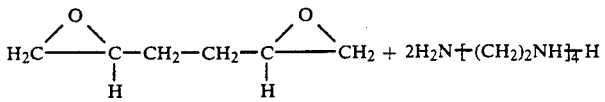

Eq. 1

-continued

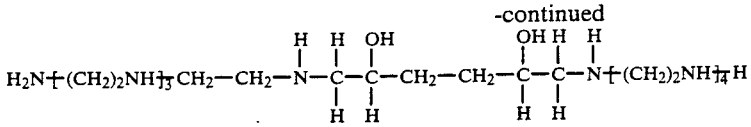

It is to be understood that if more than one molecule of the diepoxide and more than 2 molecules of the polyamine are incorporated into the resultant product, said product may be oligmeric in character. Thus for example, if more than one mole of the diepoxide of Equation 1 is reacted with more than 2 moles of the polyamine of Equation 2 the resultant product may be represented by the following structural formula

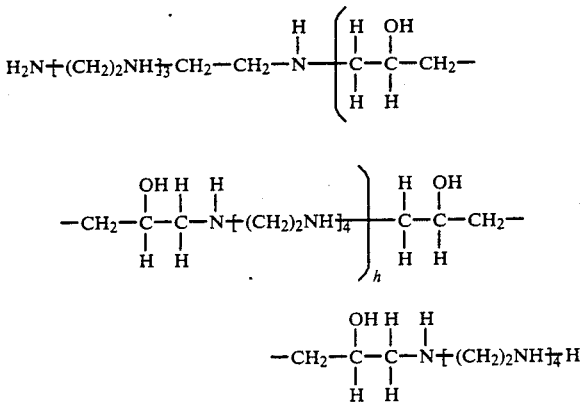

where h is a number obtained by subtracting one from the number of moles of diepoxide and is at least one.

This intermediate adduct is then reacted with (ii)(a) or (ii)(b) such as polyisobutenyl succinic anhydride, i.e., 2 moles of

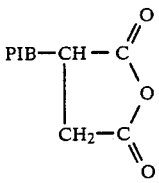

where PIB represents polyisobutylene having a number average molecular weight of from about 500 to about 6,000, to form the dispersant of the instant invention, i.e., a mixture of amides, imides and esters, e.g.,

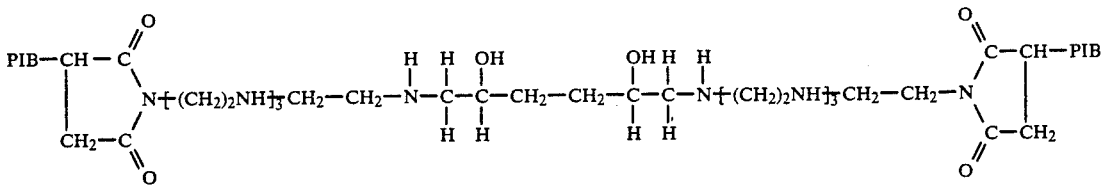

ACID PRODUCING MATERIAL

The acylating agents (ii)(a) may be reacted with the polyepoxide-polyamine, polyepoxide-polyol, and/or polyepoxide-amino alcohol intermediate adducts to form the dispersant additives of the instant invention are dicarboxylic acid materials, e.g., acid, anhydride or ester materials, which are substituted with a long chain hydrocarbyl group, generally a polyolefin, and which contain typically an average of at least about 0.7, usefully from about 0.7–2.0 (e.g., 0.9–1.6) preferably about 1.0–1.3 (e.g. 1.1–1.2) moles, per mole of hydrocarbyl, of a $C_4$ to $C_{10}$ dicarboxylic acid, anhydride or ester thereof, such as succinic acid, succinic anhydride, dimethyl methylsuccinate, etc., and mixtures thereof.

The hydrocarbyl substituted dicarboxylic acid materials, as well as methods for their preparation, are well known in the art and are amply described in the patent literature. They may be obtained, for example, by the Ene reaction between a polyolefin and an alpha-beta unsaturated $C_4$ to C10 dicarboxylic acid, anhydride or ester thereof, such as fumaric acid, itaconic acid, maleic acid, maleic anhydride, chloromaleic acid, dimethyl fumarate, etc.

The hydrocarbyl substituted dicarboxylic acid materials function as acylating agents for the polyepoxide intermediate adduct.

Preferred olefin polymers for reaction with the unsaturated dicarboxylic acid, anhydride, or ester are polymers comprising a major molar amount of $C_2$ to $C_{18}$, e.g. $C_2$ to $C_5$, monoolefin. Such olefins include ethylene, propylene, butylene, isobutylene, pentene, octene—1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases the olefin polymer may be completely saturated, for example an ethylene-propylene copolymer made by a Ziegler-Natta synthesis using hydrogen as a moderator to control molecular weight.

The olefin polymers will usually have number average molecular weights ($\overline{M}_n$) within the range of about 500 and about 6000, e.g. 700 to 3000, preferably between about 800 and about 2500, e.g., 850 to 1,000. An especially useful starting material for a disspersant additive made in accordance with this invention is polyisobutylene.

Processes for reacting the olefin polymer with the $C_4$–$C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8 wt. %, preferably 3 to 7 wt. % chlorine or bromine, based on the weight of polymer, by passing the chlorine or bromine through the polyolefin at a temperature of 25 to 160° C, e.g., 120° C., for about 0.5 to 10, preferably 1 to 7 hours. The halogenated polymer may then be reacted with sufficient unsaturated acid or anhydride at 100 to 250° C., usually about 180 to 220° C., for about 0.5 to 10 hours, e.g. 3 to 8 hours, so the product obtained will contain an average of about 0.1 to 2.0 moles, preferably 1.1 to 1.3 moles, e.g., 1.2 moles, of the unsaturated acid per mole of the halogenated polymer. Processes of this general type are taught in U.S. Pat. Nos. 3,087,436; 3,172,892; 3,272,746 and others.

Alternatively, the olefin polymer and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene, will normally react with the dicarboxylic acid material. Upon carrying out a thermal reaction without the use of halogen or a catalyst, then usually only about 50 to 85 wt. % of the polyisobutylene will react. Chlorination helps increase the reactivity. For convenience, all of the aforesaid functionality ratios of dicarboxylic acid producing units to polyolefin, e.g. 1.0 to 2.0, etc. are based upon the total amount of polyolefin, that is, the total of both the reacted and unreacted polyolefin, present in the resulting product formed in the aforesaid reactions.

POLYAMINES

Amine compounds useful as reactants with the polyepoxides to form the polyepoxide-polyamine intermediate adduct are those containing at least two reactive amino groups, i.e., primary and secondary amino groups. They include polyalkylene polyamines, of about 2 to 60 (e.g. 2 to 30), preferably 2 to 40, (e.g. 3 to 20) total carbon atoms and about 1 to 12 (e.g., 2 to 9), preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like. Hydroxy amines with 1 to 6 hydroxy groups, preferably 1 to 3 hydroxy groups are particularly useful. Such amines should be capable of reacting with the acid or anhydride groups of the hydrocarbyl substituted dicarboxylic acid moiety and with the oxirane rings of the polyepoxide moiety through the amino functionality or a substituent group reactive functionality. Since tertiary amines are generally unreactive with anhydrides and oxirane rings, it is desirable to have at least two primary and/or secondary amino groups on the amine. It is preferred that the amine contain at least one primary amino group, to facilitate reaction with the polyepoxide. Preferred amines are aliphatic saturated amines, including those of the general formulae:

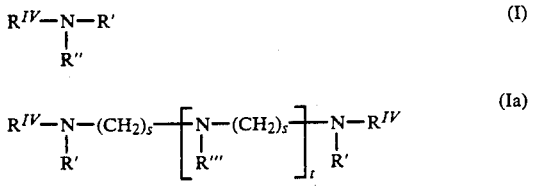

(I)

(Ia)

wherein $R^{IV}$, R', R'', and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to C12 hydroxy amino alkylene radicals; and $C_1$ to $C_{12}$ alkylamino $C_2$ to $C_6$ alkylene radicals; and wherein R'' and R''' can additionally comprise a moiety of the formula

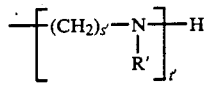

(Ib)

wherein R' is as defined above, and wherein each s and s' can be the same or a different number of from 2 to 6, preferably 2 to 4; and t and t' can be the same or different and are each numbers of typically from 0 to 10, preferably about 2 to 7, most preferably about 3 to 7, with the proviso that t +t' is not greater than 10. To assure a facile reaction it is preferred that $R^{IV}$, R'' R''', (s), (s'), (t) and (t') be selected in a manner sufficient to provide the compounds of formula Ia with typically at least two primary and/or secondary amino groups. This can be achieved by selecting at least one of said RIV, R'', or R''' groups to be hydrogen or by letting (t) in formula Ia be at least one when R''' is H or when the (Ib) moiety possesses a secondary amino group. The most preferred amines of the above formulas are represented by formula Ia and contain at least two primary amino groups and at least one, and preferably at least three, secondary amino groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N, N'-dimethyl- 1, 3 -diaminopropane; N, N'-di-(2-aminoethyl) ethylene diamine; N,N'-di(2-hyudroxyethyl)-1,3propylene diamine; N-dodecyl-1,3-propane diamine; tris hydroxymethylaminomethane (THAM); diisopropanol amine; diethanol amine; triethanol amine; mono-, di-, and tritallow amines; amino morpholines such as N-(3 aminopropyl) morpholine; and mixtures thereof.

Other useful amine compounds include: alicyclic diamines such as 1,4-di(aminoethyl) cyclohexane, and N-aminoalkyl piperazines of the general formula

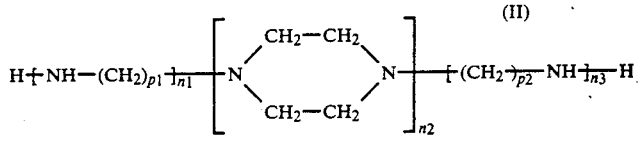

(II)

wherein $p_1$ and $p_2$ are the same or different and are each integers of from 1 to 4, and $n_1$, $n_2$ and $n_3$ are the same or different and are each integers of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines.

Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2-\text{alkylene}(O-\text{alkylene})_m NH_2 \quad (III)$$

where m has a value of about 3 to 70 and preferably 10 to 35; and $$R^V(\text{alkylene}(O-\text{alkylene})_n NH_2)_a \quad (IV)$$

where n has a value of about 1 to 40, with the provision that the sum of all the n's is from about 3 to about 70, and preferably from about 6 to about 35, and $R^V$ is a substituted saturated hydrocarbon radical of up to 10 carbon atoms, wherein the number of substituents on the $R^V$ group is from 3 to 6, and "a" is a number from 3 to 6 which represents the number of substituents on $R^V$. The alkylene groups in either formula (III) or (IV) may be straight or branched chains containing about 2 to 7, and preferably about 2 to 4 carbon atoms.

The polyoxyalkylene polyamines of formulas (III) or (IV) above, preferably polyoxyalkylene diamines and polyoxyalkylene triamines, may have number average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The polyamine is readily reacted with the polyepoxide, with or without a catalyst, simply by heating a mixture of the polyepoxide and polyamine in a reaction vessel at a temperature of about −20° C. to about 200° C., more preferably to a temperature of about 0° C. to about 180° C., and most preferably at about 30° C. to about 160° C., for a sufficient period of time to effect reaction. A solvent for the polyepoxide, polyamine and/or intermediate adduct can be employed to control viscosity and/or reaction rates.

Catalysts use fuel in the promotion of the above-identified polyepoxide-polyamine reactions are selected from the group consisting of stannous octanoate, stannous hexanoate, stannous oxalate, tetrabutyl titanate, a variety of metal organic based catalyst acid catalysts and amine catalysts, as described on page 266, and forward in a book chapter authored by R. D. Lundberg and E. F. Cox entitled, "Kinetics and Mechanisms of Polymerization: Ring Opening Polymerization", edited by Frisch and Reegen, published by Marcel Dekker in 1969, wherein stannous octanoate is an especially preferred catalyst. The catalyst is added to the reaction mixture at a concentration level of about 50 to about 10,000 parts of catalyst per one million parts by weight of the total reaction mixture.

POLYOL

In another aspect of the invention the polyepoxide intermediate adducts are prepared by reacting the polyepoxides with a polyol instead of with a polyamine Suitable polyol compounds which can be used include aliphatic polyhydric alcohols containing up to about 100 carbon atoms and about 2 to about 10 hydroxyl groups. These alcohols can be quite diverse in structure and chemical composition, for example, they can be substituted or unsubstituted, hindered or unhindered, branched chain or straight chain, etc. as desired. Typical alcohols are alkylene glycols such as ethylene glycol, propylene glycol, trimethylene glycol, butylene glycol, and polyglycols such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol, monomethyl ether of glycerol, pentaerythritol, dipentaerythritol, tripentaerythritol, 9,10-dihydroxystearic acid, the ethyl ester of 9,10-dihydroxystearic acid, 3-chloro-1,2-propanediol, 1,2-butanediol, 1,4-butanediol, 2,3-hexanediol, pinacol, tetrahydroxy pentane, erythritol, arabitol, sorbitol, mannitol, 1,2-cyclohexanediol, 1,4-cyclohexanediol, 1,4-(2-hydroxyethyl)-cyclohexane, 1,4-dihydroxyethyl-2-nirobutane, 1,4-di-(2-hydroxyethyl)-benzene, and the carbohydrates such as glucose, mannose, glyceraldehyde, galactose, and the like.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, the mono-oleate of glycerol, the monostearate of glycerol, the di-stearate of sorbitol, and the di-dodecanoate of erythritol.

A preferred class of intermediate adducts are those prepared from aliphatic alcohols containing up to 20 carbon atoms, and especially those containing three to 15 carbon atoms. This class of alcohols includes glycerol, erythritol, pentaerythritol, dipentaerythritol, tripentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,6,6-tetrakis (hydroxymethyl) -cyclohexanol, 1,10-decanediol, and the like. The adducts repared from aliphatic alcohols containing at least three hydroxyl groups and up to fifteen carbon atoms are particularly preferred.

An especially preferred class of polyhydric alcohols for preparing the polyepoxide adducts used as intermediate materials or dispersant precursors in the present invention are the polyhydric alkanols containing three to 15, especially three to six carbon atoms and having at least three hydroxyl groups. Such alcohols are exemplified in the above specifically identified alcohols and are represented by glycerol, erythritol, pentaerythritol, mannitol, sorbitol, 1,2,4-hexanetriol, and tetrahydroxy pentane and the like.

The polyol is readily reacted with the polyepoxide by heating a mixture of the polyol and polyepoxide in a reaction vessel at a temperature of about −20° C. to about 200° C., more preferably to a temperature of about 0° C. to about 180° C., and most preferable at about 30° C. to about 160° C., for a sufficient period of time to effect reaction. Optionally, a solvent for the polyepoxide, polyol and/or the resulting adduct may be employed to control viscosity and/or the reaction rates.

Catalysts useful in the promotion of the polyepoxide-polyol reactions are the base catalysts, e.g., OH —, tertiary amines, etc. The catalyst may be added to the reaction mixture at a concentration level of from about 50 to about 10,000 parts of catalyst per one million parts by weight of total reaction mixture.

AMINO ALCOHOL

In a manner analogous to that described for the polyepoxide-polyamine reaction and for the polyepoxide-polyol reaction, the polyepoxide can be reacted with an amino alcohol to form an intermediate adduct which can be further reacted with an acylating agent to form the dispersants of this invention.

Suitable amino alcohol compounds which can be reacted with the polyepoxide include those containing up to about 50 total carbon atoms and preferably up to about 10 total carbon atoms, from to about 5 nitrogen atoms, preferably from 1 to 3 nitrogen atoms, and from 1 to about 15 hydroxyl groups, preferably from about 1 to 5 hydroxyl groups. Some illustrative non-limiting examples of the amino alcohols include ethanol amine, triethanol amine, di-(2-hydroxyethyl)amine, tri-(3-hydroxypropyl)amine, and N,N'-di-(hydroxyethyl)ethylenediamine. Preferred amino alcohols include the 2,2-disubstituted—2-amino—1-alkanols having from two to three hydroxy groups and containing a total of 4 to 8 carbon atoms. These amino alcohols can be represented by the formula:

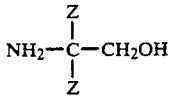

wherein Z is independently hydrogen, alkyl or hydroxyalkyl group with the alkyl groups having from 1 to 3 carbon atoms wherein at least one, and preferably both, of the X substituents is a hydroxyalkyl group of the structure $—(CH_2)_nOH$, n being 1 to 3. Examples of such amino alcohols include 2-amino—2-methyl—1,3-propanediol; 2-amino—2 -ethyl—1,3-propanediol; and 2-amino-2-(hydroxymethyl) -1,3-propanediol the latter also being known as THAM or tris(hydroxymethyl) amino methane THAM is particularly preferred because of its effectiveness, availability and low cost.

The amino alcohol is readily reacted with the polyepoxide by heating a mixture of the polyepoxide and amino alcohol in a reaction vessel at a temperature of about —20° C. to about 200° C., more preferably at temperature of about 0° C. to about 180° C., and most preferably at about 30° C. to about 160° C., for a sufficient period of time to effect reaction. Optionally, a solvent for the polyepoxide, amino alcohol and/or the reaction product may be used to control viscosity and/or the reaction rates.

Catalysts useful in the promotion of the polyepoxide-amino alcohol reactions are the same as those which are useful in connection with the polyepoxide-polyamine and polyepoxide-polyol reactions, and corresponding amounts of catalysts may be employed.

HYDROCARBYL SUBSTITUTED HYDROXY AROMATIC COMPOUNDS AND ALDEHYDES

In another embodiment of the present invention the instant dispersants are comprised of the reaction products of the intermediate adduct (i), preferably one comprised of the reaction products of at least one polyepoxide and at least one polyamine, and (ii)(b), i.e., an aldehyde and a hydrocarbyl substituted hydroxy aromatic compound.

The hydrocarbyl substituted hydroxy aromatic compounds include those compounds having the formula

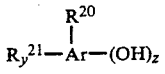

wherein Ar represents

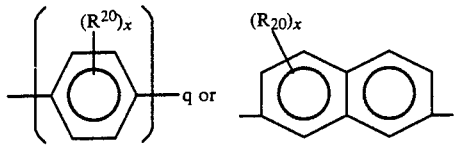

wherein q is or 2, $R^{21}$ is a long chain hydrocarbon, $R^{20}$ is a hydrocarbon or substituted hydrocarbon radical having from 1 to about 3 carbon atoms or a halogen radical such as the bromide or chloride radical y is an integer from 1 to 2, x is an integer from 0 to 2, and z is an integer from 1 to 2.

Illustrative of such Ar groups are phenylene, biphenylene, naphthylene and the like.

The preferred long chain hydrocarbon substituents are olefin polymers comprising a major molar amount of $C_2$ to $C_8$, e.g. $C_2$ to $C_5$ monoolefin. Such olefins include ethylene, propylene, butylene, pentene, octene—1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of other monomers are present, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have a number average molecular weight ($\overline{M}_n$) within the range of about 700 to about 10,000, more usually between about 700 and about 5,000. Particularly useful olefin polymers have number average molecular weight within the range of about 700 to about 3,000, and more preferably within the range of about 900 to about 2,500 with approximately one terminal double bond per polymer chain. An especially useful starting material for a highly potent dispersant additive made in accordance with this invention is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Moder Size Exclusion Liquid Chromatography", John Wiley and Sons, New York, 1979.

Processes for substituting the hydroxy aromatic compounds with the olefin polymer are known in the art and may be depicted as follows:

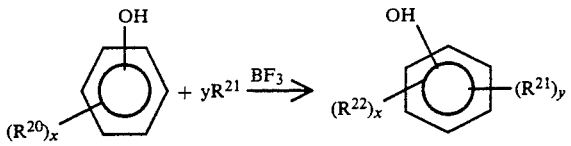

where $R^{20}$, $R^{21}$, y and x are as previously defined, and BF3 is an alkylating catalyst. Processes of this type are described, for example, in U.S. Pat. Nos. 3,539,633 and 3,649,229, the disclosures of which are incorporated herein by reference.

Representative hydrocarbyl substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene—2-chlorophenol, 4-polyisobutylene—2-methylphenol, and the like.

Suitable hydrocarbyl-substituted polyhydroxy aromatic compounds include the polyolefin catechols, the polyolefin resorcinols, and the polyolefin hydroquinones, e . g., 4-polyisob utyle ne—1 ,2-dihydroxybenzene, 3-polypropylene-1,2-dihydroxyenzene, 5-polyisobutylene-1,3-dihydroxybenzene, 4-polyamylene—1,3-dihydroxybenzene, and the like.

Suitable hydrocarbyl-substituted naphthols include 1-polyisobutylene—5-hydroxynaphthalene, 1 polypropylene-3-hydroxynaphthalene and the like.

The preferred long chain hydrocarbyl substituted hydroxy aromatic compounds to be used in this invention can be illustrated by the formula:

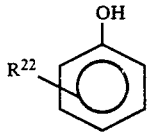

wherein $R^{22}$ is hydrocar 1 of from 50 to 300 carbon atoms, and preferably is a polyolefin derived from a $C_2$ to $C_{10}$ (e.g., $C_2$ to $C_5$) mono-alpha-olefin.

The aldehyde material which can be employed is represented by the formula:

$R^{23}CHO$ in which $R^{23}$ is a hydrogen or an aliphatic hydrocarbon radical having from 1 to 4 carbon atoms. Examples of suitable aldehydes include formaldehyde, paraformaldehyde, acetaldehyde and the like.

The reaction scheme involving the reaction between the polyepoxide, e.g., a diepoxide, and a polyamine which polyamine is present in excess e.g., TEPA, to form the intermediate adduct is represented by Equation 1. This intermediate adduct is then reacted with the hydrocarbyl substituted aromatic compound, e.g., polyisobutenyl substituted phenol, and an aldehyde, e.g., formaldehyde, to form the dispersant of this embodiment as follows:

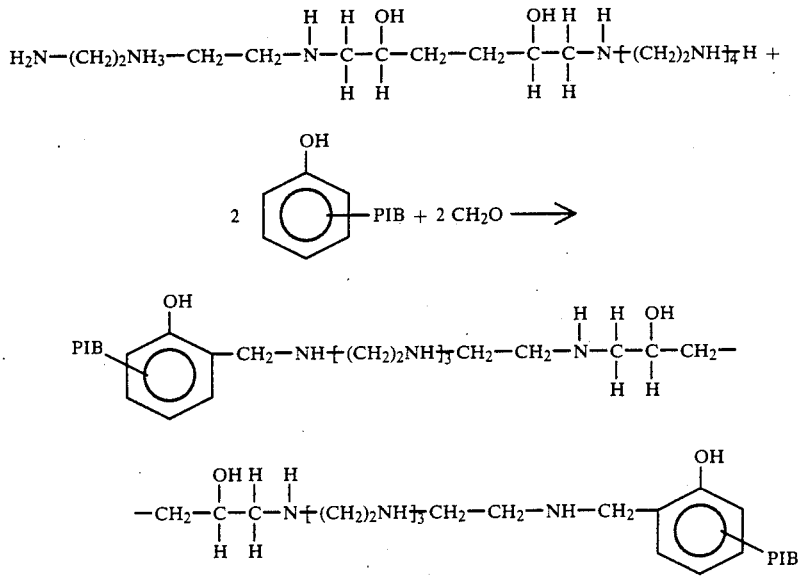

POLYEPOXIDES

The polyepoxides are compounds containing at least two oxirane rings, i.e,

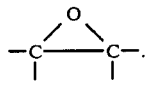

These oxirane rings are connected or joined by hydrocarbon or hydrocarbon moieties containing at least one hetero atom or group. The hydrocarbon moieties generally contain from 1 to about 100 carbon atoms. They include the alkylene, cycloalkylene, alkenylene, arylene, aralkenylene and alkarylene radicals Typical alkylene radicals are those containing from to about 100 carbon atoms, more typically from 1 to about 50 carbon atoms. The alkylene radicals may be straight chain or branched and may contain from 1 to about 100 carbon atoms, preferably from 1 to about 50 carbon atoms. Typical cycloalkylene radicals are those containing from 4 to about 16 ring carbon atoms. The cycloalkylene radicals may contain alkyl substituents, e.g., $C_1$–$C_8$ alkyl, on one or more ring carbon atoms. Typical arylene radicals are those containing from 6 to 12 ring carbons, e.g., phenylene, naphthylene and biphenylene Typical alkarylene and aralkylene radicals are these containing from 7 to about 100 carbon atoms, preferably from 7 to about 50 carbon atoms. The hydrocarbon moieties joining the oxirane rings may contain substituent groups thereon. The substituent groups are those which are substantially inert or unreactive at ambient conditions with the oxirane ring. As used in the specification and appended claims the term "substantially inert and unreactive at ambient conditions" is intended to mean that the atom or group is substantially inert to chemical reactions at ambient temperatures and pressure with the oxirane ring so as not to materially interfere in an adverse manner with the preparation and/or functioning of the compositions, additives, compounds, etc. of this invention in the context of its intended use. For example, small amounts of these atoms or groups can undergo minimal reaction with the oxirane ring without preventing the making and using of the invention as described herein. In other words, such reaction, while technically discernable, would not be sufficient to deter the practical worker of ordinary skill in the art from making and using the invention for its intended purposes. Suitable substituent groups include, but are not limited to, alkyl groups, hydroxyl groups, tertiary amino groups, halogens, and the like. When more than one substituent is present they may be the same or different It is to be understood that while many substituent groups are substantially inert or unreactive at ambient conditions with the oxirane ring, they will react with the oxirane ring under conditions effective to allow reaction of the oxirane ring with the reactive amino groups of the acylated nitrogen derivatives of hydrocarbyl substituted dicarboxylic materials. Whether these groups are suitable substituent groups which can be present on the polyepoxide depends, in part, upon their reactivity with the oxirane ring. Generally, if they are substantially more reactive with the oxirane ring than the oxirane ring is with the reactive amino group, particularly the secondary amino group, they will tend to materially interfere in an adverse manner with the preparation of the improved dispersants of this invention and are, therefore, unsuitable. If, however, their reactivity with the oxirane ring is less than or generally similar to the reactivity of the oxirane ring with the reactive amino groups, particularly a secondary amino group, they will not materially interfere in an adverse manner with the preparation of the dispersants of the present invention and may be present on the polyepoxide, particularly if the epoxide groups are present in excess relative to the substituent groups. An example of such a reactive but suitable group is the hydroxyl group. An example of an unsuitable substituent group is a primary amino group.

The hydrocarbon moieties containing at least one hetero atom or group are the hydrocarbon moieties described above which contain at least one hetero atom or group in the chain. The hetero atoms or groups are those that are substantially unreactive at ambient conditions with the oxirane rings When more then one hetero atom or group is present they may be the same or different. The hetero atoms or groups are separated from the carbon atom of the oxirane ring by at least one intervening carbon atom. These hetero atom or group containing hydrocarbon moieties may contain at least one substituent group on at least one carbon atom. These substituent groups are the same as those described above as being suitable for the hydrocarbon moieties.

Some illustrative non-limiting examples of suitable hetero atoms or groups include:

oxygen atoms (i.e., —O—or ether linkages in the carbon chain);

sulfur atoms (i.e. —S—or thioether linkages in the carbon chain);

carboxy groups (i.e., $-\overset{O}{\overset{\|}{C}}-O-$);

sulfonyl group (i.e., $-\overset{O}{\underset{O}{\overset{\|}{\underset{\|}{S}}}}-$);

ketone group (i.e., $-\overset{O}{\overset{\|}{C}}-$);

sulfinyl group (i.e., $-\overset{O}{\overset{\|}{S}}-$);

an oxirane ring (i.e., 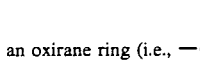 ); and nitro group.

As mentioned hereinafore the polyepoxides of the present invention contain at least two oxirane rings or epoxide moieties. It is critical that the polyepoxide contain at least two oxirane rings in the same molecule. Preferably, these polyepoxides contain no more than about 10 oxirane rings, preferably no more than about 5 oxirane rings. Preferred polyepoxides are the diepoxides, i.e., those containing two oxirane rings.

The polyepoxides useful in the instant invention are well known in the art and are generally commercially available or may readily be prepared by conventional and well known methods.

The polyepoxides include those represented by the general formula

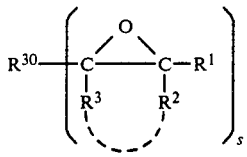

wherein:

$R^{30}$ is as valent hydrocarbon radical, a substituted s valent hydrocarbon radical, a s valent hydrocarbon radical containing at least one hetero atom or group, and a substituted s valent hydrocarbon radical containing at least one hetero atom or group; $R^1$–$R^3$ are as described herein below; and s is an integer having a value of at least 2, preferably from 2 to about 10, more preferablly from 2 to about 5. In this generic formula $R^{30}$ has the same meaning as R in Formula V below except that it is s valent rather than divalent.

Among the polyepoxides described hereinafore are those represented by the general formula.

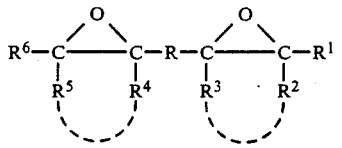

V.

wherein:

R is a divalent hydrocarbon radical, a substituted divalent hydrocarbon radical, a divalent hydrocarbon radical containing at least one hetero atom or group, and a substituted divalent hydrocarbon radical containing at least one hetero atom or group.;

$R^1$ and $R^6$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, and oxirane containing radicals;

$R^2$ and $R^3$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, monovalent oxirane containing radicals, divalent hydrocarbon radicals, and substituted divalent hydrocarbon radicals, with the proviso that if $R^2$ or $R^3$ is a divalent hydrocarbon radical or substituted divalent hydrocarbon radical then both $R^2$ and $R^3$ must be divalent hydrocarbon radicals or substituted divalent hydrocarbon radicals that together with the two carbon atoms of the oxirane ring form a cyclic structure; and $R^4$ and $R^5$ are independently selected from hydrogen, monovalent hydrocarbon radicals, substituted monovalent hydrocarbon radicals, monovalent hydrocarbon radicals containing at least one hetero atom or group, substituted monovalent hydrocarbon radicals containing at least one hetero atom or group, monovalent oxirane containing radicals, divalent hydrocarbon radicals, and substituted divalent hydrocarbon radicals, with the proviso that if $R^4$ or $R^5$ is a divalent hydrocarbon radical or substituted divalent hydrocarbon radical then both $R^4$ and $R^5$must be divalent hydrocarbon radicals or substituted divalent hydrocarbon radicals that together with the two carbon atoms of the oxirane ring form a cyclic structure.

The monovalent hydrocarbon radicals represented by $R^1$–$R^6$ generally contain from to about 100 carbon atoms. These hydrocarbon radicals include alkyl, alkenyl, cycloalkyl, aryl, aralkyl, and alkaryl radicals The alkyl radicals may contain from 1 to about 100, preferably from 1 to about 50, carbon atoms and may be straight chain or branched. The alkenyl radicals may contain from 2 to about 100 carbons, preferably from 2 to about 50 carbon atoms, and may be straight chain or branched. Preferred cycloalkyl radicals are those containing from about 4 to about 12 ring carbon atoms, e.g., cyclobutyl, cyclopentyl, cyclohexyl, cycloheptyl, etc. These cycloalkyl radicals may contain substituent groups, preferably alkyl groups, on the ring carbon atoms, e.g., methylcyclohexyl, 1,3-dimethylcyclopentyl, etc. The preferred alkenyl radicals are those containing from 2 to about 30 carbon atoms, e.g., ethenyl, 1-propenyl, 2-propenyl, etc. The preferred aryl radicals are those containing from 6 to about 12 ring carbon atoms, i.e., phenyl, naphthyl, and biphenyl. The preferred aralkyl and alkaryl radicals are those containing from 7 to about 30 carbon atoms, e.g., p-tolyl, 2,6-xylyl, 2,4,6-trimethylphenyl, 2-isopropylphenyl, benzyl, 2-phenylethyl, 4-phenylbutyl, etc.

The substituted monovalent hydrocarbon radicals represented by $R^1$–$R^6$ are the monovalent hydrocarbon radicals described hereinafore which contain at least one substituent group thereon. The substituent groups are such that they are substantially unreactive under ambient conditions with the oxirane moieties. When more than one substituent group is present they may be the same or different.

The monovalent hydrocarbon radicals containing at least one hetero atom or group are the monovalent hydrocarbon radicals described hereinafore which contain at least one hetero atom or group in the carbon chain. The hetero atom or group is separated from the carbon of the oxirane ring by at least one intervening carbon atom. When more than one hetero atom or group is present they may be the same or different. The hetero atoms or groups are those that are substantially unreactive under ambient conditions with the oxirane ring These hetero atoms or groups are those described hereinafore.

The substituted monovalent hydrocarbon radicals containing at least one hetero atom or group are the substituted monovalent hydrocarbon radicals containing at least one hetero atom or group described above which contain at least one substituent group on at least one carbon atom. The substituent groups are those described hereinafore.

The oxirane radicals represented by $R^1$–$R^6$ may be represented by the formula

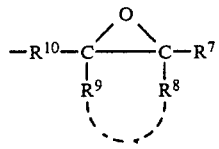

VI.

wherein:

$R^7$ has the same meaning as $R^1$, $R^8$–$R^9$ have the same meaning as $R^2$ $R^3$, and RIO has the same meaning as R in Formula V. The divalent hydrocarbon radicals represented by $R^2$–$R^5$ and $R^8$–$R^9$ generally are aliphatic acrylic radicals and contain from 1 to about 5 carbon atoms. Preferred divalent hydrocarbon radicals are the alkylene radicals. Preferred alkylene radicals are those that, together with the two carbon atoms of the oxirane ring, form a cyclic structure containing from 4 to about 8 ring carbon atoms. Thus, for example, if $R^3$ and $R^4$ are both ethylene radicals the resultant cyclic structure formed with the two carbon atoms of the oxirane ring is a cyclohexylene oxide i.e.,

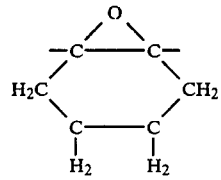

The divalent substituted hydrocarbon radicals represented by $R^2$–$R^5$ and $R^8$–$R^9$ are the divalent hydrocarbon radicals described above which contain at least one substituent group on at least one carbon atom. Thus, for example, if $R^3$ and $R^4$ are both hydroxy substituted ethylene radicals, the resultant cyclic structure formed with the two carbon atoms of the oxirane ring may be represented by the formula.

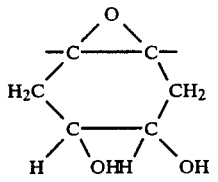

The divalent hydrocarbon radicals represented by R and $R^{10}$ generally contain from to about 100 carbon atoms, preferably from 1 to about 50 carbon atoms. They may be aliphatic, aromatic or aliphatic-aromatic. If theyare aliphatic they may be saturated or unsaturated, acrylic or alicy clic. They include alkylene, cycloalkylene, alkenylene, arylene, aralkylene, and alkarylene radicals The alkylene radicals may be straight chain or branched. Preferred alkylene radicals are those containing from 1 to about 50 carbon atoms. Preferred alkenylene radicals are those containing from 2 to about 50 carbon atoms. Preferred cycloalkylene radicals are those containing from 4.to about 12 ring carbon atoms. The cycloalkylene radicals may contain substituents, preferably alkyls, on the ring carbon atoms.

It is to be understood that the term "arylene" as used in the specification and the appended claims is not intended to limit the divalent aromatic moiety represented by R and R10 to benzene. Accordingly, it is to be understood that the divalent aromatic moiety can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono-or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sufonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages.

When the divalent aromatic moiety, Ar, is a linked polynuclear aromatic moiety it can be represented by the general formula $$-Ar(Lng-Ar)_w$$

wherein w is an integer of 1 to about 10, preferably 1 to about 8, more preferably 1, 2 or 3; Ar is a divalent aromatic moiety as described above, and each Lng is a bridging linkage individually chosen from the group consisting of carbon-to-carbon single bonds, ether linkages (e.g. —0—), keto linkages (e.g., $$-\overset{O}{\overset{\|}{C}}-),$$

sulfide linkages (e.g., —S—), polysulfide linkages of 2 to 6 sulfur atoms (e.g., $—S_2—$), sulfinyl linkages (e.g., —S (0) -) sufonyl linkages (e.g., ——S (0)2 —) lower alkylene linkages (e.g., $$-CH_2-,-CH_2-CH_2-,-CH_2-\underset{R^*}{\underset{|}{CH}}-, \text{ etc.),}$$

di (lower alkyl) -methylene linkages (e.g., $—CR^*2—$), lower alkylene ether linkages (e.g., $$-CH2-O-,-CH2-O-CH2-,-CH2-CH2-O-,$$

$$-CH_2CH_2OCH_2CH_2-,-CH_2\underset{R^*}{\underset{|}{C}}HOCH_2\underset{R^*}{\underset{|}{C}}H-$$

$$-CH_2\underset{R^*}{\underset{|}{C}}HO\underset{R^*}{\underset{|}{C}}HCH_2-$$

etc.) lower alkylene sulfide linkages (e.g., wherein one or more —0—'s in the lower alkylene ether linkages is replaced with an —S—atom), lower alkylene polysulfide linkages (e.g., wherein one or more —0—'s is replaced with a $—S_2$to $—S_6$—group), with R* being a lower alkyl group.

Illustrative of such linked polynuclear aromatic moieties are those represented by the formula

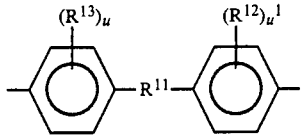

wherein $R^{12}$ and $R^{13}$ are independently selected from hydrogen and alkyl radicals, preferably alkyl radicals containing from 1 to about 2 0 carbon atoms; R11 is selected from alkylene, alkylidene, cycloalkylene, and cycloalkylidene radicals; and u and ul are independently selected from integers having a value of from 1 to 4.

The divalent substituted hydrocarbon radicals represented by R and R10 are those divalent hydrocarbon radicals described above which contain at least one substituent group of the type described hereinafore. Thus, for example, if the divalent hydrocarbon radical is a $C_5$ alkylene, the corresponding divalent substitute hydrocarbon radical, e.g., hydroxyl substituted radical, may be $$-CH_2-CH_2-\overset{OH}{\overset{|}{C}}H-CH_2-CH_2-$$

When more than one substituent group is present they may be the same or different.

The divalent hydrocarbon radicals containing at least one hetero atom or group are those divalent hydrocarbon radicals described hereinafore which contain at least one hetero atom or group. These hetero atoms or groups are those described hereinafore. Some illustrative non-limiting examples of divalent hydrocarbon radicals containing at least one hetero atom or group include:

$-CH_2-O-CH_2;-$ $-CH_2-O-CH_2-CH_2-O-CH_2-;$

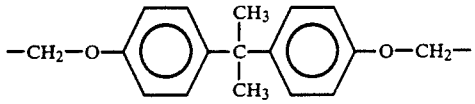

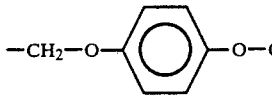

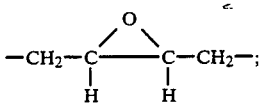

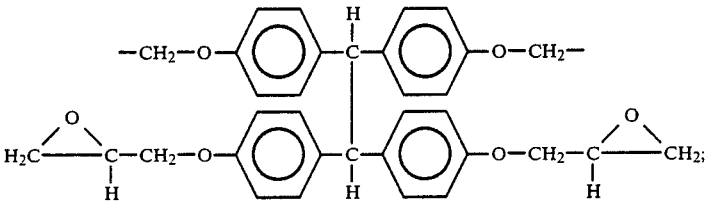

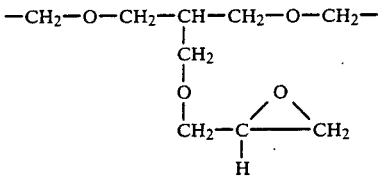

the divalent substituted hydrocarbon radicals containing at least one hetero atom or group are those divalent hydrocarbon radicals containing at least one hetero atom or group described above which contain at least one substitutent group of the type described hereinafore. Some illustrative non-limiting examples of divalent substituted hydrocarbon radicals containing at least one hetero atom or group include:

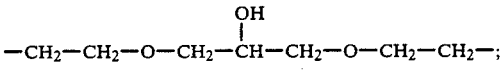

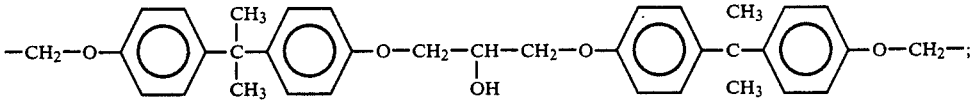

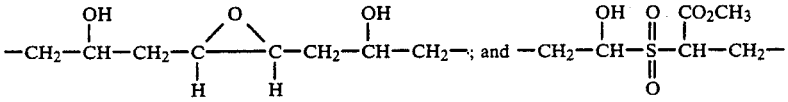

Also included within the scope of the polyepoxides of the instant invention are these represented by the formula

VII.

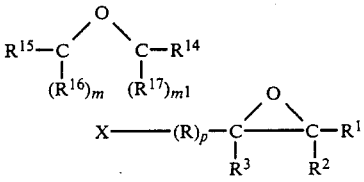

wherein:

R and $R^1$-$R^3$ are as defined hereinafore; $R^{14}$ and $R^{15}$ independently have the same meaning as $R^1$; X is an aromatic moiety; $R^{16}$ and $R^{17}$ are independently selected from divalent aliphatic acrylic hydrocarbon radicals and divalent substituted aliphatic acrylic hydrocarbon radicals which together with the two carbon atoms of the oxirane ring and the two adjacent ring carbon atoms of the aromatic moiety X form a cyclic structure;

m and $m^1$ are independently zero or one with the proviso that the sum of m plus $m^1$ is at least one; and p is zero or one.

The aromatic moieties represented by X are preferably those containing from 6 to 12 ring carbon atoms, e.g., benzene, napthalene, and biphenyl The aromatic moieties may contain one or more substituents on one or more ring carbon atoms These substituents are those which are substantially unreactive at ambient conditions, e.g., temperature and pressure, with the oxirane ring They include, for example, alkyl, hydroxyl, nitro, and the like.

Also falling within the scope of the polyepoxides of the instant invention are those represented by the formula:

VIII.

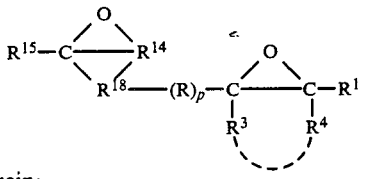

wherein:

R', $R^1$–$R^3$, $R^{14}$–$R^{15}$ and p are as defined hereinafore; and $R^{18}$ is independently selected from divalent hydrocarbon radicals or a substituted divalent hydrocarbon radicals which together with the two carbon atoms of the oxirane ring forms a cyclic preferably cycloaliphatic, structure.

The divalent hydrocarbon or substituted divalent hydrocarbon radicals represented by $R^{18}$ preferably contain from 2 to about 14 carbon atoms so as to form, together with the two carbon atoms of the oxirane ring, a 4 to about 16 membered ring structure, preferably a cycloaliphatic ring. The preferred divalent hydrocarbon radicals are the divalent aliphatic hydrocarbon radicals, preferably the alkylene radicals.

The divalent aliphatic hydrocarbon radicals represented by $R^{18}$ may contain one or more substituent groups on one or more ring carbon atoms. The substituents are selected from those that are substantially unreactive under ambient conditions with the oxirane ring, e.g., alkyl, hydroxyl, and the like.

Preferred polyepoxides of the instant invention are those wherein at least two of the oxirane rings, preferably the two terminal or end oxirane rings, are unhindered. By unhindered is meant that the oxirane ring contains one secondary carbon atom, i.e., having two hydrogens bonded thereto, and preferably contains one secondary carbon atom and one tertiary carbon atom, i.e., having one hydrogen bonded thereto. Thus, for example, an unhindered polyepoxide of Formula V is one wherein $R^1$, $R^2$, $R^5$, and $R^6$ are hydrogen, preferably one wherein $R^1$–$R^3$ and $R^4$–$R^6$ are all hydrogen Some illustrative non-limiting Examples of the polyepoxides of the instant invention include:

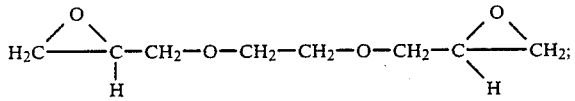

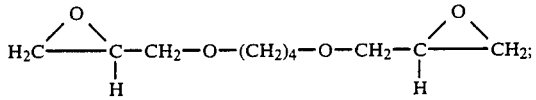

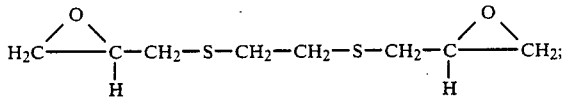

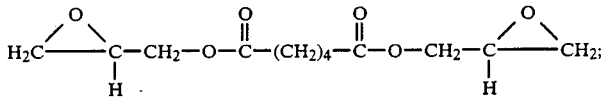

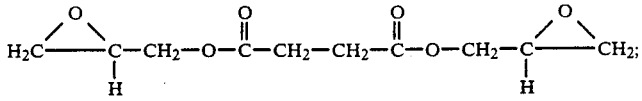

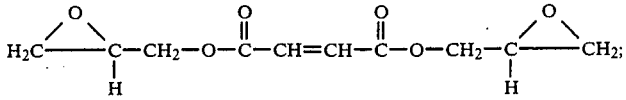

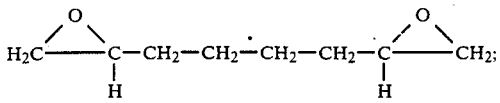

-continued
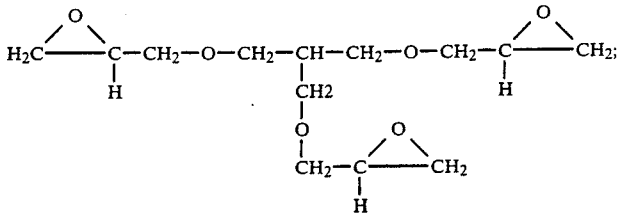
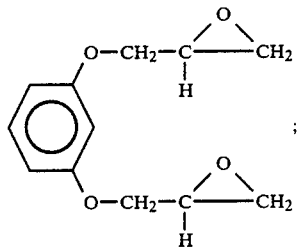
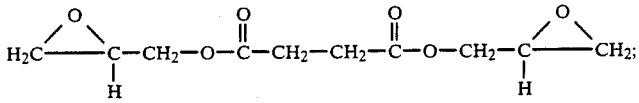
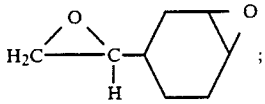
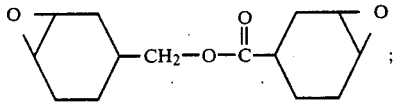
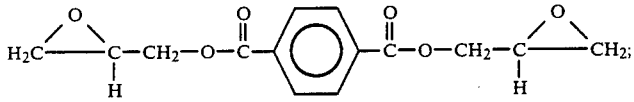
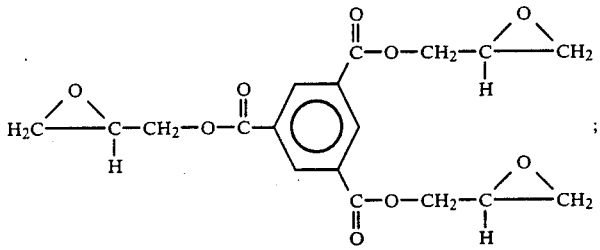
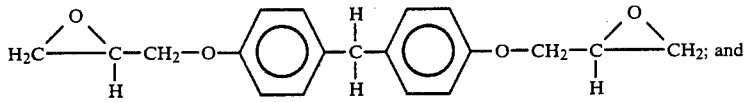
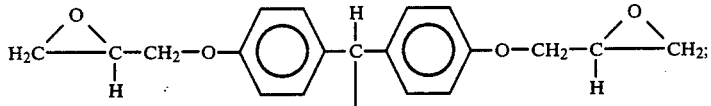
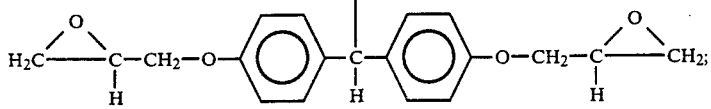
The polyepoxides useful in the instant invention also include the epoxy resins. These epoxy resins are well known in the art and are generally commercially available. They are described, for example, in billmeyer, F. W. Jr., Textbook of Polymer Science, 2nd edition, Wiley-Interscience, N.Y. 1971, pp. 479–480; Lee, H and neville, K., "Epoxy Resins", pp. 209–271 in Mark, H. f., Galylord, N. G. and Bikales, N. M., eds., Encyclopedia of Polymer Science and Technology, Vol. 6, Interscience Div., John Wiley and Sons, N.Y., 1967; and in U.S. Pat. Nos. 3,477,990 and 3,408,422; all of which are incorporated herein by reference.

The epoxy resins (or polyepoxides) include those compounds possessing one or more vicinal epoxy groups. These polyepoxides are saturated or unsaturated, aliphatic, cycloaliphatic, aromatic or heterocyclic, and are substituted, if desired, with non-interfering substituents, such as halogen atoms, hydroxyl groups, ether radicals, and the like.

of polyhydric phenols wherein the aromatic ring structure of the phenols have been or are saturated.

Preferred saturated epoxy resins are the hydrogenated resins prepared by the process described in U.S. Pat. No. 3,336,241. More preferred are the hydrogenated glylcidyl ethers of 2,2—bis(4—hydroxyphenyl) propane, sometimes called the diglycidyl ethers of 2,2—bis(4—cyclohexanol) propane.

One class of useful epoxy resins are those prepared by condensing epichlorohydrin with bisphenol-A. They include resins represented by the general structural formula

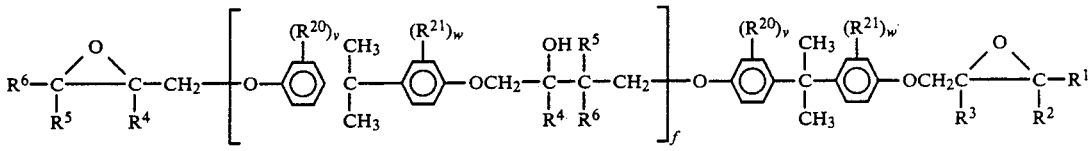

Preferred polyepoxides are the glycidyl polyethers of polyhydric phenols and polyhydric alcohols, especially the glycidyl polyethers of 2,2—bis(4—hydroxyphenyl) propane having an average molecular weight between about 300 and 3,000 and an epoxide equivalent weight (WPE) between about 140 and 2,000. Especially preferred are the diglycidyl polyethers of 2,2—bis(4—hydroxyphenyl) propane having a WPE between about 140 and 500 and an average molecular weight of from about 300 to about 900.

Other suitable epoxy compounds include those compounds derived from polyhydric phenols and having at least one vicinal epoxy group wherein the carbon-to-carbon bonds within the six-membered ring are saturated. Such epoxy resins may be obtained by at least two well-known techniques, i.e., by the hydrogenation of glycidyl polyethers of polyhydric phenols or (2) by the reaction of hydrogenated polyhydric phenols with epichlorohydrin in the presence of a suitable catalyst such as Lewis acids, i.e., boron trihalides and complexes thereof, and subsequent dehydrochlorination in an alkaline medium. The method of preparation forms no part of the present invention and the resulting saturated epoxy resins derived by either method are suitable in the present compositions.

Briefly, the first method comprises the hydrogenation of glycidyl polyethers of polyhydric phenols with hydrogen in the presence of a catalyst consisting of rhodium and/or ruthenium supported on an inert carrier at a temperature below about 50° C. This method is thoroughly disclosed and described in U.S. Pat. No. 3,336,241, issued Aug. 15, 1967.

The hydrogenated epoxy compounds prepared by the process disclosed in U.S. Pat. No. 3,336,241 are suitable for use in the present compositions Accordingly, the relevant disclosure of U.S. Pat. No. 3,336,241 is incorporated herein by reference.

The second method comprises the condensation of a hydrogenated polyphenol with an epihalohydrin, such as epichlorohydrin, in the presence of a suitable catalyst such as BF3, followed by dehydrohalogenation in the presence of caustic. When the phenol is hydrogenated Bisphenol A, the resulting saturated epoxy compound is sometimes referred to as "diepoxidized hydrogenated Bisphenol A," or more properly as the diglycidyl ether of 2,2—bis(4—cyclohexanol) propane.

In any event, the term "saturated epoxy resin," as used herein shall be deemed to mean the glycidyl ethers wherein:

$R^1$–$R^6$ are defined hereinafore, and preferably are all hydrogen;

$R^{20}$ is independently selected from alkyl radicals, preferably alkyl radicals containing from to about 10 carbon atoms, hydroxyl, or halogen radicals;

$R^{21}$ is independently selected from alkyl radicals, preferably alkyl radicals containing from 1 to about 10 carbon atoms, hydroxyl, or halogen radicals;

v is independently selected from integers having a value of from 0 to 4 inclusive;

w is independently selected from integers having a value of from 0 to 4 inclusive; and f has a value of at least one, and varies according to the molecular weight of the resin, with the upper-limit of f preferably not exceeding about 10, more preferably not exceeding about 5.

Preferred compounds of Formula X are those wherein $R^1$–$R^6$ are all hydrogen, and v and w are all zero.

An example of commercially available and useful epoxy resins are the EPON resins of Shell Oil Company As mentioned hereinafore those polyepoxides, including the epoxy reins, wherein the two carbon atoms of the oxirane ring are bonded to three hydrogen atoms, e.g., wherein $R^1$–$R^6$ in Formula V are all hydrogen, are preferred. Preferred polyepoxides of this type are those wherein the hydrocarbon moieties bridging the epoxide moieties, e.g., R in Formula V, contain polar groups or atoms. These polar groups or atoms include, but are not limited to, the polar hetero atoms or groups described hereinafore. Particularly preferred polyepoxides are the epoxy resins, especially those devised from polyhydric phenols.

These polyepoxides are reacted with the polyamines, polyols or amino alcohols described hereinafore to produce the intermediate adducts which are then reacted with the aforedescribed acylating agents to yield the dispersants of the present invention.

The reaction between a polyamine and a polyepoxide to form the intermediate polyepoxide-polyamine adduct is described, for the case of a diepoxide, in Equation 1 above. In this reaction the different oxirane moieties in the same polyepoxide molecule react, by an oxirane ring opening mechanism, with the primary amino groups on different polyamine molecules to join or link together different polyamine molecules via the polyepoxide molecule.

If a polyepoxide containing more than two oxirane rings per molecule such as a triepoxide is reacted with a polyamine such as TEPA in a 1: 3 mole ratio then three molecules of polyamine will be linked or connected together by the polyepoxide This is illustrated by the following reaction scheme:

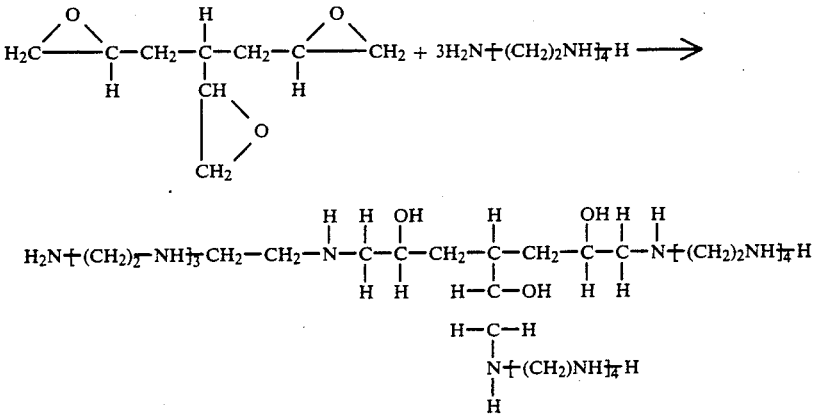

If a polyamine containing more than two, e.g., three, primary amino groups per molecule is used then one such polyamine molecule may be linked or connected to three other polyamine molecules by three diepoxide molecules. In such case the three primary amino groups on each polyamine molecule react with oxirane rings on different diepoxide molecules.

The chemistry of the polyepoxide-polyamine reaction is such that the primary amino functionality in the polyamine is more reactive than the secondary amino functionality with the oxirane ring of the polyepoxide and therefore the product structure illustrated in Equations 1 and 2 will be the favored product. It is also possible, however, that the secondary amino functionality or the hydroxyl functionality of the resulting adduct can react with further molecules of the polyepoxide to form a diversity of structures.

In general the polyepoxide-polyamine intermediate adducts of the present invention comprise molecules of polyamines linked to each other by polyepoxide molecules. For purposes of illustration and exemplification only, and assuming that the polyamine is a polyamine of Formula I and the polyepoxide is a diepoxide of Formula V, the polyepoxide-polyamine intermediate adduct contains at least one of the following recurring structural units

IX.

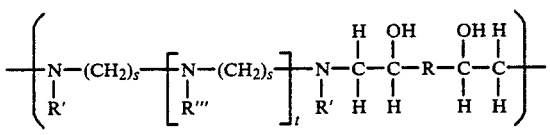

wherein R, R'', R''', s and t are as defined hereinafore.

The stoichiometry of the polyepoxide and polyamine is one of the factors that determines the length of the polyepoxide-polyamine adduct, e.g., number of recurring structural units of Formula X. Generally, increasing the concentration in the reaction mixture of the polyepoxide, up to a point where there is present an equivalent amount of oxirane ring moieties per primary amino moieties, results in an increase in the length and molecular weight of the intermediate adduct.

Other factors which influence the length and molecular weight of the adduct are reaction times and reaction temperatures and the presence or absence of other reactive groups in the polyepoxide Generally, assuming a fixed amount of polyepoxide in the polyepoxide-polyamine reaction mixture, a higher reaction temperature and/or a longer reaction time results in longer or higher molecular weight intermediate adduct product.

Reaction between the polyepoxide and polyamine is carried out by adding an amount of polyepoxide to the polyamine which is effective to couple or link at least some of the polyamine molecules. It is readily apparent to those skilled in the art that the amount of polyepoxide utilized depends upon a number of factors including (1) the number of primary amino groups present in the polyamine, (2) the number of oxirane rings present in the polyepoxide, (3) and the number of polyamines that it is desired to react, i.e., the degree of coupling or chain length of the polyepoxide-polyamine adduct it is desired to achieve. It is generally preferred that the polyamine be present in excess in the polyepoxide-polyamine reaction mixture.

Generally, however, it is preferred to utilize an amount of polyepoxide such that there are present from about 0.01 to 10 equivalents of epoxide groups per equivalent of primary amino groups, preferably from about 0.1 to 5 equivalents of epoxide groups per equivalent of primary amino group.

With appropriate variations to provide for the presence of hydroxyl groups the aforedescribed method and discussion for the preparation of the polyepoxide-polyamine intermediate adducts is also applicable to the polyepoxide-polyol and polyepoxide-amino alcohol adducts.

In order to form the dispersants of the present invention the long chain hydrocarbyl substituted dicarboxylic acid material or the aldehyde and hydrocarbyl substituted hydroxy aromatic compound is reacted with a polyepoxide-polyamine adduct, a polyepoxide-polyol adduct, a polyepoxide-amino alcohol, or a mixture thereof. The amounts of polyepoxide adduct and hydrocarbyl substituted dicarboxylic acid material or the aldehyde and hydrocarbyl substituted hydroxy aromatic compound utilized in this reaction are amounts which are effective to form the dispersants of the instant invention, i.e., dispersant forming effective amounts. It will be apparent to those skilled in the art that the amount of polyepoxide adduct utilized will depend, in part, upon the number of reactive groups (reactive primary and/or secondary amino groups and/or hydroxy groups in the polyepoxide-polyamine adduct, reactive hydroxyl groups in the polyepoxide-polyol adduct, etc.) present in said polyepoxide adduct which are available for reaction with, for example, carboxylic acid or anhydride groups of the hydrocarbyl substituted dicarboxylic acid material. Generally, however, the amount of the polyepoxide adduct is such that sufficient polyepoxide adduct is present to provide from about 0.5 to 15, preferably from about 1 to 10, and more preferably from about 2 to 4 reactive groups or equivalents, e.g., primary or secondary amino groups or hydroxy groups, for each dicarboxylic acid or anhydride group or equivalent present in the hydrocarbyl substituted dicarboxylic acid material.

The reaction conditions under which the reaction between the polyepoxide adduct and the hydrocarbyl substituted dicarboxylic acid material is carried out are those that are effective for coreaction between said polyepoxide adduct and the hydrocarbyl substituted dicarboxylic acid material to occur. Generally, the reaction will proceed at from about 50°. to 250° C., preferably 100 to 210° C. While super-atmospheric pressures are not excluded, the reaction generally proceeds satisfactorily at atmospheric pressure. The reaction may be conducted using a mineral oil, e.g., 100 neutral oil, as a solvent An inert organic co-solvent, e.g., xylene or toluene, may also be used. The reaction time generally ranges from about 0.5–24 hours.

The reaction between the polyepoxide-polyamine adduct and the hydrocarbyl substituted dicarboxylic acid material may be exemplified by the following reaction scheme which represents the reaction of polyisobutenyl succinic anhydride with an alkylene diepoxide/tetraethylene pentamine adduct:

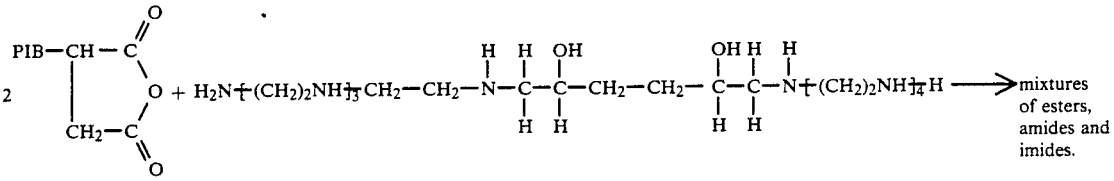

The imide reaction product of this reaction may be represented by the formula

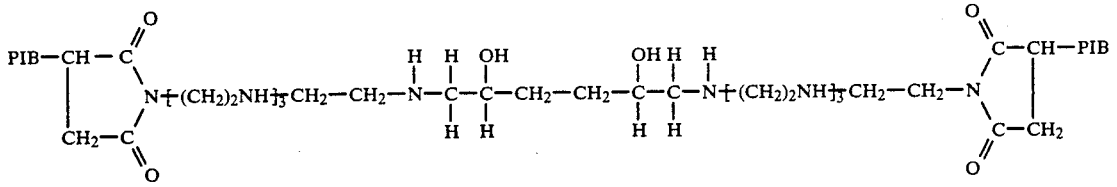

where PIB is polyisobutylene.

Further aspects of the present invention reside in the formation of metal complexes and other post-treatment derivatives, e.g., borated derivatives, of the novel additives prepared in accordance with this invention. Suitable metal complexes may be formed in accordance with known techniques of employing a reactive metal ion species during or after the formation of the present $C_5$–$C_9$ lactone derived dispersant materials. Complex-forming metal reactants include the nitrates, thiocyanates, halides, carboxylates, phosphates, thio-phosphates sulfates, and borates of transition metals such as iron, cobalt, nickel, copper, chromium, manganese, molybdenum, tungsten, ruthenium, palladium, platinum, cadmium, lead, silver, mercury, antimony and the like Prior art disclosures of these complexing reactions may be found in U.S. Pat. Nos. 3,306,908 and Re. 26,443.

Post-treatment compositions include those formed by reacting the novel additives of the present invention with one or more post-treating reagents, usually selected from the group consisting of boron oxide, boron oxide hydrate, boron halides, boron acids, sulfur, sulfur chlorides, phosphorous sulfides and oxides, carboxylic acid or anhydride acylating agents, epoxides and episulfides and acrylonitriles. The reaction of such post-treating agents with the novel additives of this invention is carried out using procedures known in the art. For example, boration may be accomplished in accordance with the teachings of U.S. Pat. No. 3,254,025 by treating the additive compound of the present invention with a boron oxide, halide, ester or acid. Treatment may be carried out by adding about 1–3 wt. % of the boron compound, preferably boric acid, and heating and stirring the reaction mixture at about 135° C. to 165° C. for to 5 hours followed by nitrogen stripping and filtration, if desired. Mineral oil or inert organic solvents facilitate the process.

The compositions produced in accordance with the present invention have been found to be particularly useful as fuel and lubricating oil additives.

When the compositions of this invention are used in normally liquid petroleum fuels, such as middle distillates boiling from about 150 to 800° F. including kerosene, diesel fuels, home heating fuel oil, jet fuels, etc., a concentration of the additive in the fuel in the range of typically from 0.001 wt. % to 0.5 wt. %, preferably 0.005 wt. % to 0.2 wt %, based on the total weight of the composition, will usually be employed These additives can contribute fuel stability as well as dispersant activity and/or varnish control behavior to the fuel.

The compounds of this invention find their primary utility, however, in lubricating oil compositions, which employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like.

Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble of stably dispersible in oil to an extent sufficient to exert their intended effect in the environment in which the oil is employed Moreover, the additional incorporation of other additives may also permit incorporation of higher levels of a particular polymer adduct hereof, if desired Accordingly, while any effective amount of these additives can be incorporated into the fully formulated lubricating oil composition, it is contemplated that such effective amount be sufficient to provide said lube oil composition with an amount of the additive of typically from 0.01 to about 10, e.g., 0.1 to 6.0, and preferably from 0.25 to 3.0 wt. %, based on the weight of said composition.

The additives of the present invention can be incorporated into the lubricating oil in any convenient way. Thus, they can be added directly to the oil by dispersing, or dissolving the same in the oil at the desired level of concentration, typically with the aid of a suitable solvent such as toluene, cyclohexane, or tetrahydrofuran. Such blending can occur at room temperature or elevated.

Natural base oils include mineral lubricating oils which may vary widely as to their crude source, e.g., whether paraffinic, naphthenic, mixed, paraffinicnaphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cSt. at 100° C.

Thus, the additives of the present invention can be employed in a lubricating oil composition which comprises lubricating oil, typically in a major amount, and the additive, typically in a minor amount, which is effective to impart enhanced dispersancy relative to the absence of the additive. Additional conventional additives selected to meet the particular requirements of a temperatures. In this form the additive per se is thus being utilized as a 100% active ingredient form which can 1 added to the oil or fuel formulation by the purchase: oil-soluble solvent and base oil to form concentrate, which may then be blended with a lubricating oil base stock to obtain the final formulation Concentrates will typically contain from about 2 to 80 wt. %, by weight of the additive, and preferably from about 5 to 40% by weight of the additive.

The lubricating oil base stock for the additive of the present invention typically is adapted to perform selected function by the incorporation of additives therein to form lubricating oil compositions (i.e., formulations).

Representative additives typically present in such formulation include viscosity modifiers, corrosion inhibitors, oxidation inhibitors, friction modifiers, other dispersants, anti-foaming agents, anti-wear agents, pour point depressants, detergents, rust inhibitors and the like.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have weight average molecular weights of from about 10,000 to 1,000,000, preferably 20,000 to 500,000, as determined by gel permeation chromatography or light scattering methods.

Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from to 5 to 30 wt. % of a sulfide of phosphorus for ½ to 15 hours, at temperature in the range of about 66 to about 316° C. Neutralization of the phosphosulfurized hydrocarbon may be effected in the manner taught in U S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e g calcium nonylphenol sulfide, barium toctylphenyl sulfide, dioctylphenylamine, phenylalphanaphthylamine, phospho-sulfurized or sulfurized hydrocarbons, etc.

Other oxidation inhibitors or antioxidants useful in this invention comprise oil-soluble copper compounds. The copper may be blended into the oil as any suitable oilsoluble copper compound By oil soluble it is meant that the compound is oil soluble under normal blending conditions in the oil or additive package. The copper compound may be in the cuprous or cupric form. The copper may be in the form of the copper dihydrocarbyl thio- or dithio-phosohates. Alternatively, the copper may be added as the copper salt of a synthetic or natural carboxylic acid Examples of same thus include $C_{10}$ to $C_{18}$ fatty acids, such as stearic or palmitic acid, but unsaturated acids such as oleic or branched carboxylic acids such as napthenic acids of molecular weights of from about 200 to 500, or synthetic carboxylic acids, are preferred, because of the improved handling and solubility properties of the resulting copper carboxylates Also useful are oil-soluble copper dithiocarbamates of the general formula ($R^{20}R^{21}$, NCSS) zCu (where z is 1 or 2, and $R^{20}$ and $R^{21}$, are the same or different hydrocarbyl radicals containing from 1 to 18, and preferably 2 to 12, carbon atoms, and including radicals such as alkyl, alkenyl, aryl, aralkyl, alkaryl and cycloaliphatic radicals Particularly preferred as $R^{20}$ and $R^{21}$, groups are alkyl groups of from 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., $R^{20}$ and $R^{21}$, ) will generally by about 5 or greater. Copper sulphonates, phenates, and acetylacetonates may also be used.

Exemplary of useful copper compounds are copper CuI and/or CuII salts of alkenyl succinic acids or anhydrides The salts themselves may be basic, neutral or acidic. They may be formed by reacting (a) polyalkylene succinimides (having polymer groups of of 700 to 5,000) derived from polyalkylene-polyamines, which have at least one free carboxylic acid group, with (b) a reactive metal compound Suitable rective metal compounds include those such as cupric or cuprous hydroxides, oxides, acetates, borates, and carbonates or basic copper carbonate.

Examples of these metal salts are Cu salts of polyisobutenyl succinic anhydride, and Cu salts of polyisobutenyl succinic acid. Preferably, the selected metal employed is its divalent form, e.g., $Cu+2^{\circ}$. The preferred substrates are polyalkenyl succinic acids in which the alkenyl group has a molecular weight greater than about 700. The alkenyl group desirably has a $\overline{M}_n$ from about 900 to 1,400, and up to 2,500, with a $\overline{M}_n$ of about 950 being most preferred. Especially preferred is polyisobutylene succinic anhydride or acid. These materials may desirably be dissolved in a solvent, such as a mineral oil, and heated in the presence of a water solution (or slurry) of the metal bearing material. Heating may take place between 70° C. and about 200° C. Temperatures of 100° C. to 140° C. are entirely adequate It may be necessary, depending upon the salt produced, not to allow the reaction to remain at a temperature above about 140° C. for an extended period of time, e.g., longer than 5 hours, or decomposition of the salt may occur.

The copper antioxidants (e.g , Cu-polyisobutenyl succinic anhydride, Cu-oleate, or mixtures thereof) will be generally employed in an amount of from about 50 to 500 ppm by weight of the metal, in the final lubricating or fuel composition.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 Which discloses glycerol esters of dimerized fatty acids; U S Pat. No. 3,779,928 which disclosed alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinalic acid and mixtures therefore U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference The most preferred friction modifiers are succinate esters, or metal salts thereof, of hydrocarbyl substituted succinic acids or anhydrides and thiobisalkanols such as described in U.S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz. overbased) metal sales, such as highly basic alkaline earth metal sulfonates (especially Ca and Mg salts)

are frequently used as detergents. Representative examples of such materials, and their methods of preparation, are found in co-pending Ser. No. 754,001, filed July 11, 1985, the disclosure of which is hereby incorporated by reference.

Some of these numerous additives can provide a multiplicity of effects, e g , a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Wt % a.i. (Broad) | Wt. % a.i. (Preferred) |
|---|---|---|
| Viscosity Modifier | .01-12 | .01-4 |
| Corrosion Inhibitor | .01-5 | .01-1.5 |
| Oxidation Inhibitor | .01-5 | .01-1.5 |
| Dispersant | .1-20 | .1-8 |
| Pour Point Depressant | .01-5 | .01-1.5 |
| Anti-Foaming Agents | .001-3 | .001-0.15 |
| Anti-Wear Agents | .001-5 | .001-1.5 |
| Friction Modifiers | .01-5 | .01-1.5 |
| Detergents/Rust Inhibitor | .01-10 | .01-3 |
| Mineral Oil Base | Balance | Balance |

When other additives are employed it may be desirable, although not necessary, to prepare additive concentrates comprising concentrated solutions or dispersions of the dispersant (in concentrate amounts hereinabove described), together with one or more of said other additives (said concentrate when constituting an additive mixture being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically by formulated to contain the dispersant additive and optional additional additives in proper amounts to provide the desired concentration in the final formulation when the additive-package is combined with a predetermined amount of base lubricant Thus, the products of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight percents expressed herein are based on active ingredient (a.i.) content of the additive, and/or upon the total weight of any additive-package, or formulation which will be the sum of the a.i. weight of each additive plus the weight of total oil or diluent.

This invention will be further understood by reference to the following examples, wherein all parts are parts by weight and all molecular weights are number weight average molecular weights as noted, and which include preferred embodiments of the invention.

The following example illustrates a dispersant of the instant invention.

EXAMPLE 1

Into a reactor vessel are charged, under a nitrogen blanket and with stirring, 100 grams of S150NR mineral oil, 25.8 grams of aminoethyl piperazine and 17.4 (0.1 mole) grams of ethylene glycol diglycidyl ether. This mixture is permitted to react for one hour at 20°-60° C., after which reaction period 200 grams of polybutene succinic anhydride (reaction product of maleic anhydride and polybutene having a of 950, said reaction product having a polybutene to succinic anhydride ratio of about 1:1) are added over a 10-minute period. The resultant reaction mixture is heated at 149° C. and sparged with nitrogen for one-half hour. The residue is diluted further with 15.55 grams of S150NR mineral oil per 81.45 grams of residue to yield a solution of the dispersant having a viscosity at 100° C. of 242.5 centistokes.

The following example illustrates a dispersant falling outside the scope of the instant invention in that no polyepoxide is utilized in the preparation of this dispersant. This example is presented for comparative purposes only.

COMPARATIVE EXAMPLE 2

The procedure of Example 1 is substantially repeated, utilizing the same ratios of S150NR mineral oil, and aminoethyl piperazine and polybutene succinic anhydride reactants as in Example 1, with the exception that no ethylene glycoldiglycidyl ether is present during the reaction. The oil solution of the residue, which residue is diluted with S150NR mineral oil to substantially the same degree as the residue of Example 1, has a viscosity at 100° C. of 76.3 centistokes The higher viscosity of the oil solution of the residuc of Example 1 is indicative of the fact that the polyepoxide reactant of Example 1 is effective in increasing the molecular weight of the dispersant.

What is claimed is:

1. A composition useful as dispersant additive for lubricating oil compositions consisting essentially of reaction product of:

(i) at least one nitrogen containing adduct consisting essentially of reaction product of
  (a) at least one polyepoxide wherein the polyepoxide contains at least two oxirane rings joined by a divalent organic moiety selected from the group consisting of hydrocarbon moieties, and substituted hydrocarbon moieties; and
  (b) at least one polyamine wherein the polyamine contains at least two reactive amino groups selected from primary amino groups and secondary amino groups; and (ii) at least one long chain hydrocarbyl substituted $C_4$-$C_{10}$ dicarboxylic acid material, wherein said long chain substitutent is derived from an olefin polymer having a number average molecular weight of about 500 to about 6,000./

2. The composition of claim 1 wherein said long chain hydrocarbyl substituted $C_4$-$C_{10}$ dicarboxylic acid material is comprised of reaction product of olefin polymer of $C_2$-$C_{18}$ monoolefin having a number average molecular weight of from about 500 to about 6,000, and $C_4$-$C_{10}$ monounsaturead dicarboxylic acid material.

3. The composition of claim 2 wherein said olefin polymer is polyisobutylene.

4. The composition of claim 3 wherein said monounsaturated dicarboxylic acid producing material is maleic anydride.

5. The composition of claim 4 wherein the number average molecular weight of said polyisobutylene is from about 800 to about 2,500.

6. The composition of claim 1 wherein said reactive aminmo groups are primary amino groups.

7. The composition of claim 6 wherein said polyamine contains in addition to the primary amino groups at least one secondary amino group.

8. The composition of claim 1 wherein said polyamine is an aliphatic saturated amine represented by the formula

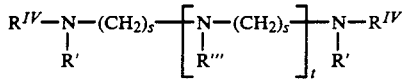

wherein:

$R^{IV}$, R' and R''' are independently selected from the group consisting of hydrogen, $C_{1\ l\ to\ C25}$ straight or branched chain alkyl radicals, $C_1$ to $C_{12}$ alkoxy $C_2$ to $C_6$ alkylene radicals, and $C_2$ to $C_{12}$ alkylamino $C_2$ to $C_6$ alkylene radicals;

each s is independently selected from integers having a value of from 2 to 6; and t is a number of 0 to 10, with the proviso that when t=0 at least one of $R^{IV}$, R''' or R' must be hydrogen such that there are at least two of either primary or secondary amino groups.

9. The composition of claim 1 wherein said polyamine is selected from poly(alkylene amines).

10. The composition of claim 1 wherein said polyamine is a poly(oxyalkylene amine).

11. The composition of claim 1 wherein said hydrocarbon moiety is selected from alkylene, cycloalkylene, alkenylene, arylene, aralkenylene, and alkarylene moieties.

12. The composition of claim 1 wherein said polyepoxide contains at least two oxirane rings wherein one oxirane ring carbon atom is bonded to two hydrogen atoms.

13. The composition of claim 12 wherein one carbon atom in the second oxirane ring is bonded to one hydrogen atom.

14. A lubricating oil composition comprising:

(A) a major amount of lubricating oil; and (B) a minor amount of oil soluble dispersant compound consisting essentially of reaction product of (i) at least one nitrogen containing adduct consisting essentially of reaction product of (a) at least one polyepoxide wherein the polyepoxide contains at least two oxirane rings joined by a divalent organic moiety selected from the group consisting of hydrocarbon moieties, and substituted hydrocarbon moieties, (b) at least one polyamine wherein the polyamine contains at least two reactive amino groups selected from primary amino groups and secondary amino groups; and (ii) at least one long chain hydrocarbyl substituted $C_4$–$c_{10}$ dicarboxylic acid material, wherein said long chain hydrocarbyl substitutent is derived from an olefin polymer having a number average molecular weight of about 500 to about 6,000.

15. The composition of claim 14 wherein said long chain hydrocarbyl substituted $C_4$–$C_{10}$ dicarboxylic acid material is comprised of reaction product of olefin polymer of at least one $C_2$–$C_{18}$ monoolefin having a number average molecular weight of about 500 to about 6,000, and $C_4$–$c_{10}$ monounsaturated dicarboxylic acid material.

16. The composition of claim 15 wherein said olefin polymer is polyisobutylene.

17. The composition of claim 16 wherein said monounsaturated dicarboxylic acid material is maleic anhydride.

18. The composition of claim 17 wherein the number average molecular weight of said polyisobutylene is from about 800 to about 2,500.

19. The composition of claim 14 wherein said reactive amino groups are primary amino groups.

20. The composition of claim 19 wherein said polyamine contains in addition to the primary amino groups at least one secondary amino group.

21. The composition of claim 14 wherein said polyamine is an aliphatic saturated amine represented by the formula

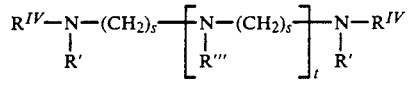

wherein:

$R^{IV}$, R' and R''' are independently selected from the group consisting of hydrogen, $C_1$ to $C_{25}$ straight and branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals;

each s is independently selected from integers having a value of from 2 to 6; and t is a number of 0 to 10, with the proviso that when t=0 at least one of $R_{IV}$, R''' or R' must be hydrogen such that there are at least two of either primary or secondary amino groups.

22. The composition of claim 14 wherein said polyamine is selected from poly(alkylene amines).

23. The composition of claim 14 wherein said polyamine is a poly(oxyalkylene amino).

24. The composition of claim 14 wherein said hydrocarbon moiety is selected from alkylene, cycloalkylene, alkenylene, arylene, aralkenylene, and alkarylene moieties.

25. The composition of claim 14 wherein said polyepoxide contains at least two oxirane rings wherein one of the oxirane ring carbon atoms is bonded to two hydrogen atoms.

26. The composition of claim 25 wherein one carbon atom in the second oxirane ring is bonded to one hydrogen atom.

27. A process for preparing a composition useful as lubricating oil dispersant additive consisting essentially of:

(i) forming reaction product consisting essentially of at least one polyepoxide and at least one polygamies wherein the polyamine contains at least two reactive amino groups selected from primary amino groups and secondary amino groups; and (ii) reacting said reaction product (i) with at least one long chain hydrocarbyl substituted $C_4$–$c_{10}$ dicarboxylic acid material, said long chain hydrocarbyl substituted $C_4$–$C_{10}$ acid material consisting essentially of reaction product of olefin polymer of $C_2$–$C_{18}$ monoolefin and having a number average molecular weight of from about 500 to 6,000 and $C_4$–$C_{10}$ monounsaturated dicarboxylic acid material.

28. The process of claim 27 wherein said $C_4$–$C_{10}$ monounsaturated dicarboxylic acid material is maleic anhydride, which when reacted with said olefin polymer forms one or more succinic anhydride moieties.

29. The process of claim 28 wherein there are present from about 0.7 to about 2 succinic anhydride moieties per olefin polymer moiety in the said long chain hydrocarbyl substituted $C_4$–$C_{10}$ dicarboxylic acid material, and wherein then umber average molecular weight of said olefin polymer is from about 800 to about 2,500.

30. The process of claim 27 wherein said polyamine has from 2 to about 60 total carbon atoms and from about 2 to about. 12 nitrogen atoms.

31. The process of claim 30 wherein said polyamine is an aliphatic saturated amine having the formula:

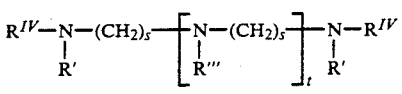

wherein $R^{IV}$, R'' and R''' are independently selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals; each s is the same or a different number of from 2 to 6; and t is a number of from 0 to 10, with the proviso that when t =0 at least one of $R^{IV}$, R''' or R' must be H such that there are at least two of either primary or secondary amino groups.

32. The process of claim 27 wherein said amine is selected from poly(alkylene amines).

33. The process of claim 27 wherein said polyamine is a poly(oxyalkylene amine).

34. The process of claim 27 wherein an excess amount of polyamine is used over the stoichiometric amount of polyamine required to react with all of the oxirane rings contained in said polyepoxide informing reaction product (i).

35. The process of claim 27 wherein the provide from about 0.01to about 10 equivalents of epoxide moieties per one reactive amino moiety, said reactive amino moiety being selected from the group consisting of primary and secondary amino moieties.

36. The process of claim 35 wherein the polyepoxide reactant is used in an amount sufficient to provide from about 0.1 to about 5 equivalents of epoxide moieties per one reactive amino moiety

37. The composition of claim 14 which contains a dispersant effective amount of (B).

38. The composition of claim 37 which contains from about 0.01 to about 10 wt. % of (B).

39. The composition of claim 14 wherein said polyepoxide is a diepoxide.

40. A lubricating oil composition comprising:

(A) lubricating oil; and (B) dispersant effective amount of oil soluble dispersant composition consisting essentially of reaction product of (i) reaction product consisting essentially of (a) polyepoxide wherein the polyepoxide contains at least two oxirane rings joined by a divalent organic moiety selected from the group consisting of hydrocarbon oieties, and substituted hydrocarbon moieties reacted with (b) polyamine wherein the polyamine contains at least two reactive amino groups selected from primary amino groups and secondary amino groups, and (ii) long chain hydrocarbyl substituted $C_4$–$C_{10}$ dicarboxylic acid or anhydride, wherein said long chain hydrocarbyl substitutent is derived from an olefin polymer having a number average molecular weight of about 500 to about 6,000.

41. The composition of claim 40 wherein said long chain hydrocarbyl substituted $C_4$–$C_{10}$ dicarboxylic acid or anhydride consists essentially of reaction product of olefin polymer having a number average molecular weight of about 500 to about 6,000 and being derived from at least one $C_2$–$C_{18}$ monoolefin and a $C_4$–$C_{10}$ monounsaturated dicarboxylic acid or anhydride.

42. The composition of claim 41 wherein said olefin polymer is comprised of polyisobutene.

43. The composition of claim 41 wherein said monounsaturated dicarboxylic acid material is maleic anhydride.

44. The composition of claim 43 wherein the number average molecular weight of said olefin polymer is from about 800 to about 2,500.

45. The composition of claim 40 wherein said reactive amino groups are primary amino groups.

46. The composition of claim 45 wherein said polyamine contains in addition to the reactive primary amino groups at least one secondary amino group.

47. The composition of claim 40 wherein said polyamine is aliphatic a saturated polyamine represented by the formula

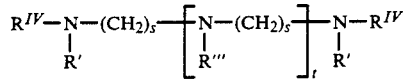

wherein:

$R^{IV}$, R' and R''' are independently selected from the group consisting of hydrogen, $C_1$ to $C_{25}$ straight and branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals;

each s is independently selected from integers having a value of from 2 to 6; and t is a number from 0 t 10, with the proviso that when t=0 at least one or $R^{IV}$, R''' or R'must be hydrogen such that there are present at least two of either primary or secondary amino groups.

48. The composition of claim 40 wherein said polyamine is selected from poly(alkylene amines).

49. The composition of claim 40 wherein said polyamine is a poly(oxyalkylene amine).

50. The composition of claim 40 wherein said hydrocarbon moiety is selected from alkylene, cycloalkylene, alkenylkene, arylene, aralkenylene, and alkarylene moieties.

51. The composition of claim 42 wherein said polyepoxide contains at least two oxirane rings wherein one oxirane ring carbon atom is bonded to two hydrogen atoms.

52. The composition of claim 51 wherein one carbon atom in the second oxirane ring is bonded to one hydrogen atom.

53. A lubricating oil additive concentrate composition comprising:

(A) 20 to 98% by weight lubricating oil; and (B) 2 to 80% by weight oil soluble dispersant composition consisting essentially of reaction product of (i) reaction product consisting essentially of (a) at least one polyepoxide wherein the polyepoxide contains at least two oxirane rings joined by a divalent organic moiety selected from the group consisting of hydrocarbon moieties, and substituted hydrocarbon moieties, and (b) at least one polyamine where the polyamine contains at least two reactive amino groups selected from primary amino groups and secondary amino groups; and (ii) at least one long chain hydrocarbyl substituted $C_4$-$C_{10}$ dicarboxylic acid material, wherein said long chain substituent is derived from an olefin polymer having a number average molecular weight of about 500 to about 6,000.

54. The composition of claim 53 wherein said long chain hydrocarbyl substittued $C_4$-$C_{10}$ dicarboxylic acid material is comprised of reaction product of an olefin polymer having a number average molecular weight of about 500 to about 6,000 and being derived from at least one $C_2$-$C_{18}$ monoolefin, and $C_4$-$C_{10}$ monounsaturated dicarboxylic acid material.

55. The composition of claim 654 wherein said olefin polymer is polyisobutene.

56. The composition of claim 54 wherein said monounsaturated dicarboxylic acid material is maleic anhydride.

57. The composition of claim 56 wherein the number average molecular weight of said polyisobutene is from about 800 to about 2,500.

58. The composition of claim 53 wherein said reactive amino groups are primary amino groups.

59. The composition of claim 58 wherein said polyamine contains in addition to the reactive primary amino groups at least one secondary amino group.

60. The composition of claim 53 wherein said polyamine is an aliphatic saturated amine represented by the formula

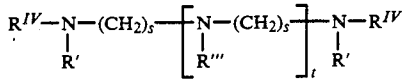

wherein:

$R^{IV}$, R' and R''' are independently selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals;

each s is independently selected from integers having a value of from 2 to 6; and t is a number of 0 to 10, with the proviso that when t=0 at least one of $R^{IV}$, R''' or R'must be hydrogen such that there are at least two of either primary or secondary amino groups.

61. The composition of claim 53 wherein said polyamine is selected from poly(alkyolene mines).

62. The composition of claim 53 wherein said polyamine is a poly(oxyalkylene amine)(.

63. The composition of claim 53 wherein said hydrocarbon moiety is selected from alkylene, cycloalkylene, alkenylene, arylene, aralkenylene, and alkarylene moieties.

64. The composition of claim 53 wherein said polyepoxide contains at least two oxirane rings wherein one oxirane ring carbon atom is bonded to two hydrogen atoms.

65. The composition of claim 64 wherein one carbon atom in he second oxirane ring is bonded to one hydrogen atom.

* * * * *